US008734248B2

(12) United States Patent
Greenberg et al.

(10) Patent No.: US 8,734,248 B2
(45) Date of Patent: May 27, 2014

(54) SYSTEM FOR PROCESSING INPUT IN A WAGERING GAME MACHINE

(75) Inventors: Jacob C. Greenberg, Elgin, IL (US); James M. Rasmussen, Chicago, IL (US); Mark B. Gagner, West Chicago, IL (US); Jeremy Gill, Chicago, IL (US); Bruce Blair, Oak Park, IL (US)

(73) Assignee: WMS Gaming Inc., Waukegan, IL (US)

( * ) Notice: Subject to any disclaimer, the term of this patent is extended or adjusted under 35 U.S.C. 154(b) by 893 days.

(21) Appl. No.: 12/438,223

(22) PCT Filed: Aug. 21, 2007

(86) PCT No.: PCT/US2007/018488
§ 371 (c)(1),
(2), (4) Date: Feb. 20, 2009

(87) PCT Pub. No.: WO2008/024348
PCT Pub. Date: Feb. 28, 2008

(65) Prior Publication Data

US 2010/0291992 A1 Nov. 18, 2010

Related U.S. Application Data

(60) Provisional application No. 60/822,964, filed on Aug. 21, 2006.

(51) Int. Cl.
*G07F 17/32* (2006.01)

(52) U.S. Cl.
USPC ..... 463/31; 463/16; 463/20; 463/25

(58) Field of Classification Search
USPC ..... 463/16, 20, 30
See application file for complete search history.

(56) References Cited

U.S. PATENT DOCUMENTS

2004/0038725 A1 2/2004 Kaminkow

FOREIGN PATENT DOCUMENTS

CA 2549416 A1 6/2005
EP 1069538 A2 1/2001

OTHER PUBLICATIONS

"International Application Serial No. PCT-US07/18488, International Preliminary Report on Patentability mailed May 4, 2009", 6 pgs.
"International Application Serial No. PCT/US2007/018488, Written Opinion mailed Jun. 24, 2008", 5 pgs.
"International Application Serial No. PCT/US2007/018488, Search Report mailed Jun. 24, 2008", 4 pgs.
Canadian Application Serial No. 2,661,048, Office Action mailed Nov. 15, 2012, 4 pgs.

*Primary Examiner* — Omkar Deodhar
(74) *Attorney, Agent, or Firm* — Nixon Peabody LLP

(57) ABSTRACT

Systems and methods for processing input in a wagering game machine are described herein. In some embodiments, an apparatus comprises a button panel for a wagering game machine. The button panel comprises a main button circuit board. The button panel also comprises at least one socket mounted to the main button circuit board. The button panel comprises a number of display components plugged into the at least one socket, wherein each display component comprises a display coupled to a display circuit board, wherein at least one switch used to determine a button press is mounted on each display circuit board.

27 Claims, 21 Drawing Sheets

SYSTEM FOR PROCESSING INPUT IN A WAGERING GAME MACHINE

RELATED APPLICATION

This patent application is a U.S. National Stage Filing under 35 U.S.C. 371 from International Patent Application Serial No. PCT/US2007/018488, filed Aug. 21, 2007, and published on Feb. 28, 2008, as WO 2008/024348 A2 and republished as WO 2008/024348 A3, which claims the priority benefit of U.S. Provisional Patent Application Ser. No. 60/822,964 filed Aug. 21, 2006 and entitled "SYSTEM FOR PROCESSING INPUT IN A WAGERING GAME MACHINE", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

BACKGROUND

Wagering game machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Some embodiments of the invention are illustrated in the Figures of the accompanying drawings in which.

DESCRIPTION OF THE EMBODIMENTS

This description of the embodiments is divided into five sections. The first section describes example button panels, while the second section describes wagering game machine architectures. The third section describes operations performed by some embodiments. The fourth section describes some example wagering game machines and the fifth section presents some general comments.

Introduction

Wagering game machines often use buttons as a primary means for processing player input. For example, wagering game machines typically include buttons that enable players to bet, select or manipulate game elements, cash-out, etc. Because buttons are often the primary player-input devices, they often endure a relatively high level of wear and tear. Some embodiments of the invention reduce this wear and tear by reducing the number moving parts in a button panel (e.g., parts that move when the buttons are pressed).

Some embodiments enable wagering game machines to configure their buttons for different wagering game types. For example, a wagering game machine may allow players to select between slots, poker, or blackjack. If a player selects slots, the wagering game machine will configure itself to present slots games. However, if the player selects a different game type (i.e., poker or blackjack), the machine will configure itself to present the selected game type. As part of the configuration process, the wagering game machines configure their buttons for different games. For example, for poker games, a machine's buttons may show indicia indicating which buttons are for betting, drawing cards, and folding. When the machine configures itself to present games of a different type (e.g., slots), the same buttons may show different indicia indicating different button functionalities. Furthermore, some embodiments enable different button actions for different game types. For example, for some game types, a button may generate one input when a player presses one area of the button (e.g., the button's top edge) and a different input when the player presses another area (e.g., the button's bottom edge). For other game types, the button may generate only one input, irrespective of where the button is pressed.

These and other features of the embodiments will be described in greater detail below.

Example Hardware

This section describes various button panels according to example embodiments of the invention.

Button Panels

Figure 1:
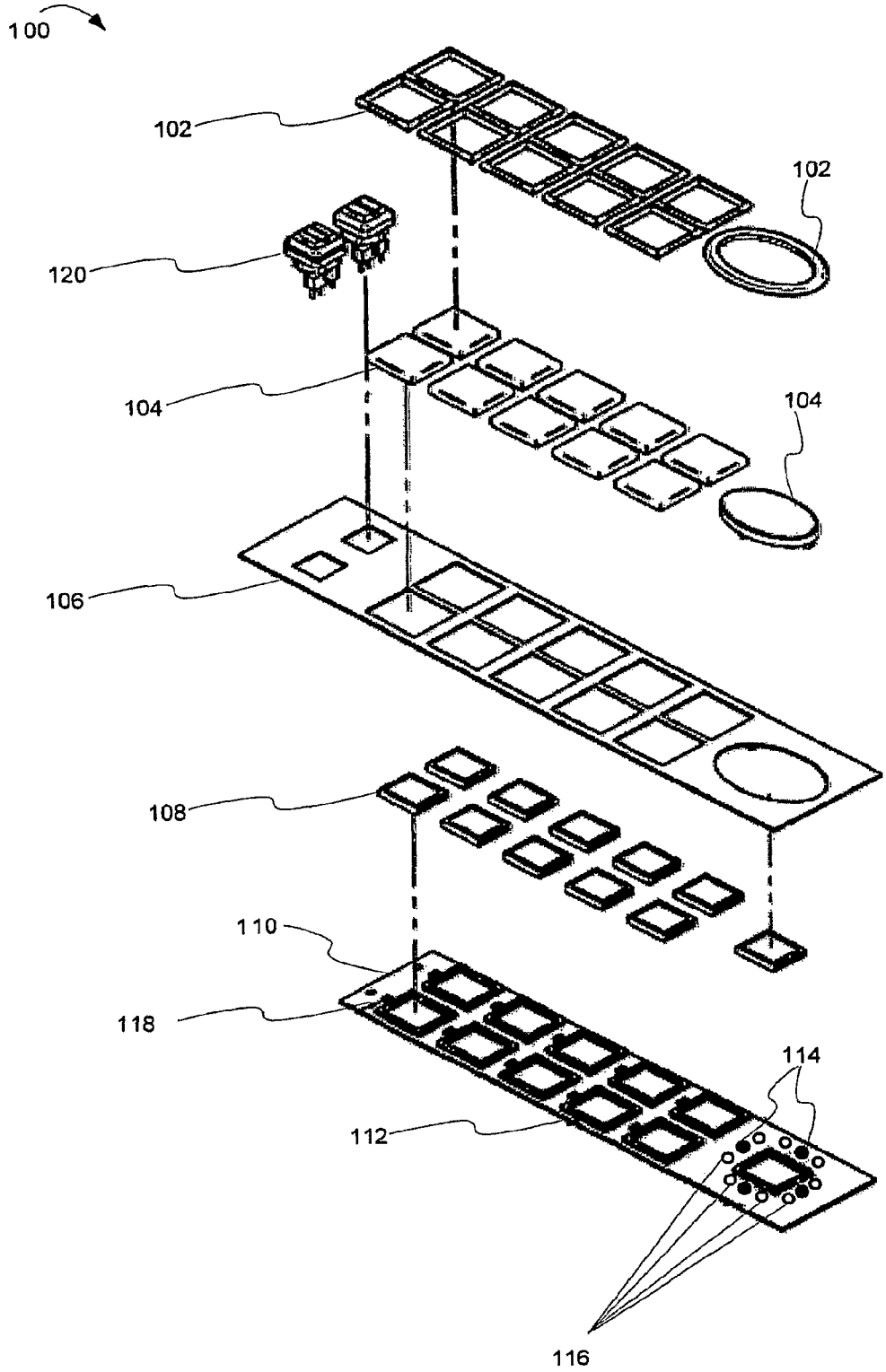
FIG. 1 shows an exploded view of a wagering game machine button panel, according to example embodiments of the invention.

FIG. 1 shows an exploded view of a wagering game machine button panel, according to example embodiments of the invention. In FIG. 1, the button panel 100 includes bezels 102, lenses 104, a plate 106, variable displays 108 and a circuit board 110. There are several components mounted on the circuit board 110, including switches 114 and 118, sockets 112, and light emitting diodes (LEDs) 116. The button panel 100 also includes other input devices 120.

In one embodiment, the bezels 102, lenses 104, and plate 106 can snap together to form a top-side assembly. Similarly, the variable displays 108 can plug into the sockets 112 to form a bottom-side assembly. In one embodiment, the bottom-side assembly can be mounted to a wagering game machine cabinet, while the top-side assembly can overlay the bottom-side assembly. Some embodiments include an electromagnetic shield between the top-side and bottom-side assemblies.

The components of the button panel 100 make up a plurality of buttons. In some embodiments, each button includes a lens 104, bezel 102, variable display 108, and one or more switches 118. Each button has a touch surface upon which a player applies pressure in order to press the button. When the button panel 100 is mounted in a wagering game machine, players can press the buttons by applying pressure to the lenses 104. In some embodiments, the buttons can include springs (not shown) for repositioning the lenses 104 after the buttons are pressed. In one embodiment, the bottom-side assembly does not move when the buttons are pressed.

In some embodiments, the variable displays 108 can present text, icons, still images, full-motion video streams, computer-generated graphics, or any other suitable video content. The variable displays 108 can include liquid crystal displays (LCDs), organic light emitting diodes (OLEDs), or any other suitable electronic display components.

In some embodiments, an acrylic sheet is laid over the variable displays 108 to produce a three-dimensional effect for the image on the variable displays 108. In some embodiments, the acrylic sheet comprises Perspex® Lenticular from Lucite®. The acrylic sheet may comprise a number of optical grade lenses or lenticules, running approximately parallel through out the length of the sheet. The acrylic sheets may include various Lenses Per Inch (LPI) (e.g., 75 LPI, 100 LPI, 60 LPI, 3D-100 LPI, 140 LPI, 40 LPI, etc.). The lenses on the acrylic sheet may be configured to allow an eye of a viewer to view less than all of the pixels on the display. For examples, the lenses on the acrylic sheet may be configured to allow the left eye to view the even pixels and the right eye to view the odd pixels, thus producing a three dimensional effect of the image on the displays 108.

As noted above, the circuit board 110 includes switches 114 and 118. The switches 114 make-up a four-way actuator for one button, while the switches 118 make-up one-way actuators for other buttons of the button panel 100. The circuit board can include additional light sources, such as LEDs, for illuminating the bezels 102. Any of the light sources on the circuit board 110 can be independently controlled.

The circuit board 110 also includes sockets 112, which simply power and data to the variable displays 108. The power and data can originate from a power supply and central processing unit (CPU) of the wagering game machine in which the button panel 100 resides. In one embodiment, the circuit board 110 can connect to the power supply and CPU with one or two cables.

Figure 2A:
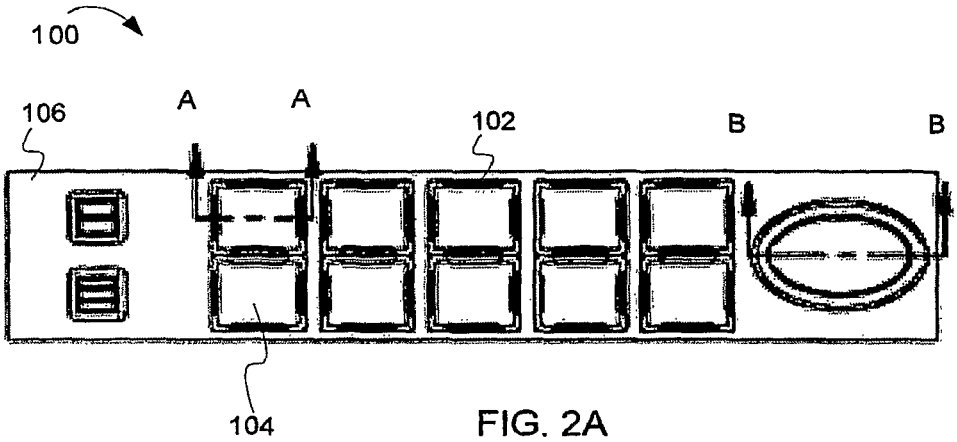
FIG. 2A is a top view of the button panel 100, according to example embodiments of the invention.
Figure 2B:
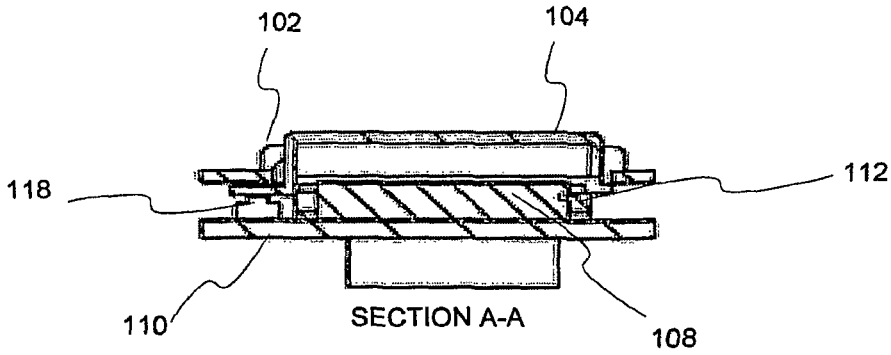
FIG. 2B is a cross-sectional view of the button panel 100, according to example embodiments of the invention.
Figure 2C:
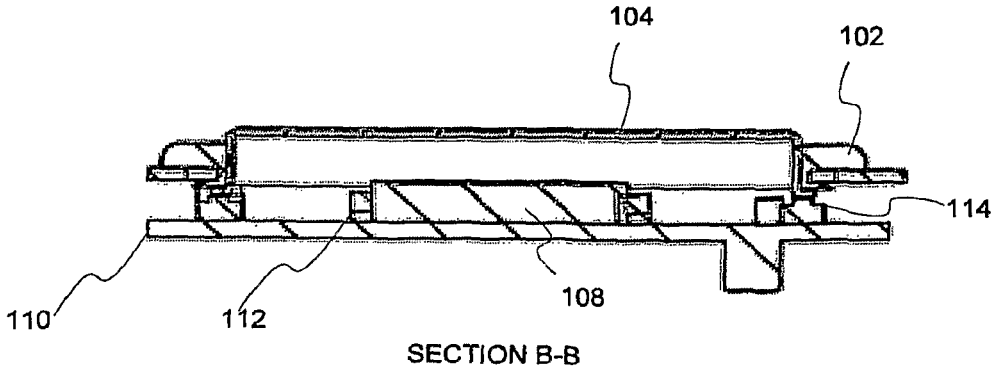
FIG. 2C is another cross-sectional view of the button panel 100, according to example embodiments of the invention.

While FIG. 1 shows an exploded view of the button panel 100, FIGS. 2A-2C show other views of the button panel. This section continues with a discussion of FIGS. 2A-2C.

FIG. 2A is a top view of the button panel 100, according to example embodiments of the invention. As shown in FIG. 2A, the button panel 100 includes the plate 106, lenses 104, and bezels 102. The cross sectional views A-A and B-B are shown in FIGS. 2B and 2C, respectively.

FIG. 2B is a cross-sectional view of the button panel 100, according to example embodiments of the invention. In FIG. 2B, the section A-A view shows embodiments of the bezel 102, lens 104, switch 118, socket 112, circuit board 110, and variable display 108.

FIG. 2C is another cross-sectional view of the button panel 100, according to example embodiments of the invention. In FIG. 2C, the section B-B view shows embodiments of the bezel 102, lens 104, switch 114, socket 112, circuit board 110, and variable display 108.

Multi-Switch Buttons

This section continues with a discussion of embodiments in which a single button includes multiple switches. FIGS. 3A-3E illustrate some example multi-switch buttons.

Figure 3A:
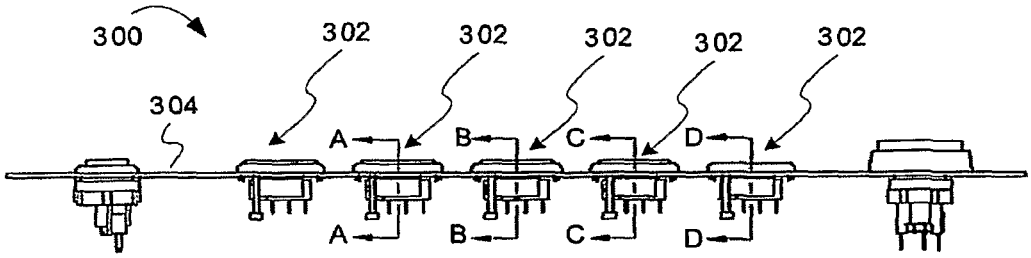
FIG. 3A illustrates a button panel with buttons that include a plurality of switches, according to example embodiments of the invention.

FIG. 3A illustrates a button panel with buttons that include a plurality of switches, according to example embodiments of the invention. In FIG. 3, the button panel 300 includes a plate 304 and buttons 302. Each button 302 includes a plurality of switches (shown in FIGS. 3B-3E) that enable the button 302 to generate different inputs when different areas of the button 302 are pressed. These and other features are described in greater detail in the discussion of FIGS. 3B-3E.

Figure 3B:
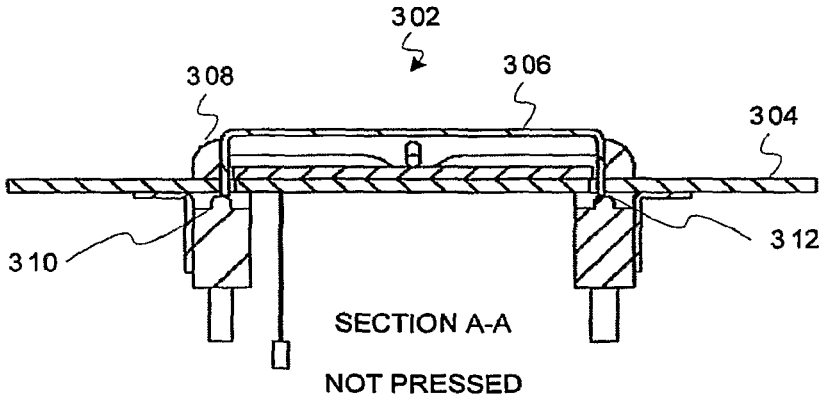
FIG. 3B illustrates a cross-sectional view of the button 302, according to example embodiments of the invention.

FIG. 3B illustrates a cross-sectional view of the button 302, according to example embodiments of the invention. In particular, FIG. 3B shows section A-A from FIG. 3A. In FIG. 3B, the button 302 includes a lens 306, bezel 308, plate 304, and switches 310 and 312. The button 302 is not in a "pressed" position. That is, the lens 306 is not in contact with either of the switches 310 or 312. The following discussion of FIGS. 3C-3E will describe how pressing the lens 306 (i.e., the button's touch surface) can actuate the switches 310 and 312.

Figure 3C:
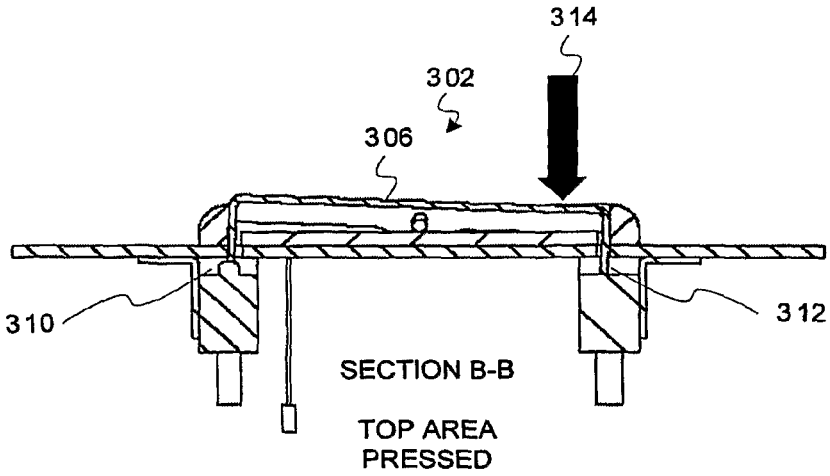
FIG. 3C illustrates a cross-sectional view of the button 302 with a force being applied to an area of the lens 306, according to example embodiments of the invention.

FIG. 3C illustrates a cross-sectional view of the button 302 with a force being applied to an area of the lens 306, according to example embodiments of the invention. In particular, FIG. 3C shows section B-B from FIG. 3A. As shown in FIG. 3C, when a force 314 is applied to an area near the top edge of the lens 306, the lens 306 actuates the switch 312. In one embodiment, when the switch 312 is actuated, the switch 312 sends an input signal to a central processing unit (CPU) or other wagering game machine component (not shown). In one embodiment, the switches 310 and 312 each generate different inputs when actuated independently.

Figure 3D:
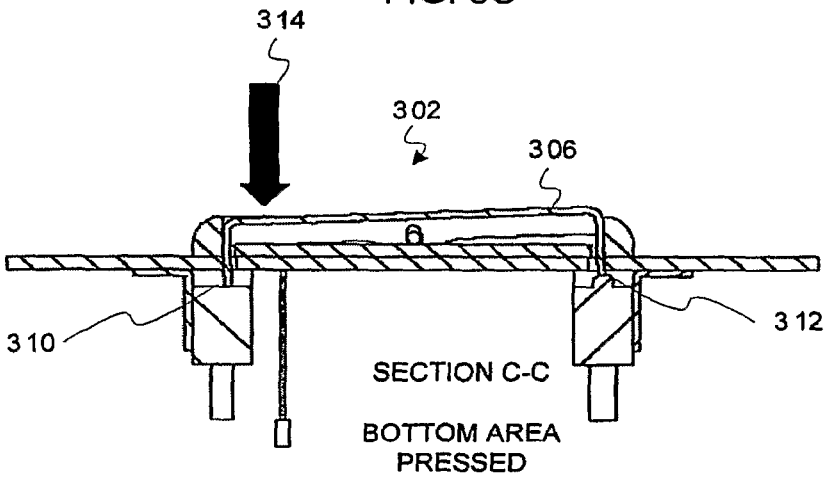
FIG. 3D illustrates another cross-sectional view of the button 302 with a force being applied to an area of the lens 306, according to example embodiments of the invention.

FIG. 3D illustrates another cross-sectional view of the button 302 with a force being applied to an area of the lens 306, according to example embodiments of the invention. In particular, FIG. 3D shows section C-C of FIG. 3A. As shown in FIG. 3D, when a force 314 is applied to an area near the bottom edge of the lens 306, the lens 306 actuates the switch 310, sending an input signal to a CPU or other wagering game machine component.

Figure 3E:
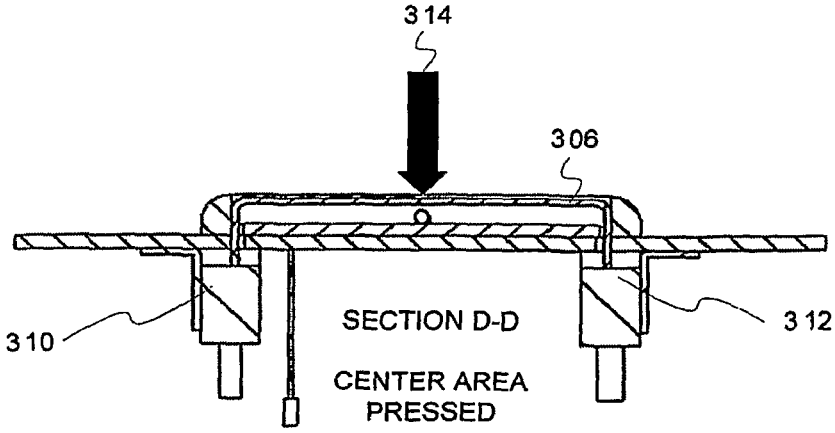
FIG. 3E illustrates yet another cross-sectional view of a button 302 with a force being applied to an area of the lens 306, according to example embodiments of the invention.

While FIGS. 3C and 3D show only one of the switches 310 and 312 being actuated, FIG. 3E shows both switches 310 and 312 being actuated simultaneously.

FIG. 3E illustrates yet another cross-sectional view of a button 302 with a force being applied to an area of the lens 306, according to example embodiments of the invention. In particular, FIG. 3E shows section D-D of FIG. 3A. As shown in FIG. 3E, when a force 314 is applied to an area in the center of the lens 306, the lens 306 actuates both switches 310 and 312, sending an input signal to a CPU or other wagering game machine component. In one embodiment, when the switches 310 and 312 are actuated simultaneously, they generate an input signal that differs from the signals generated when both switches are actuated independently.

Figure 4A:
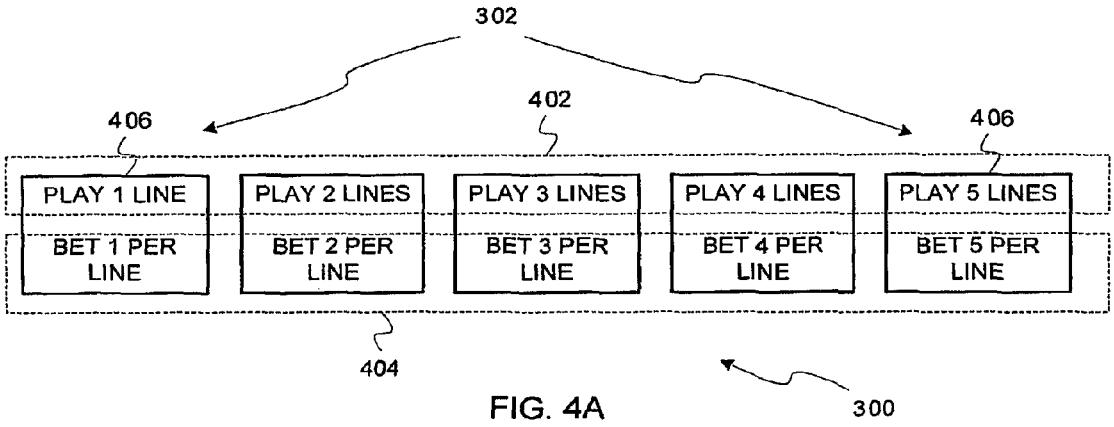
FIG. 4A is a block diagram illustrating embodiments in which a button can present a plurality of indicia which indicate a plurality inputs generated by the button, according to example embodiments of the invention.
Figure 4B:
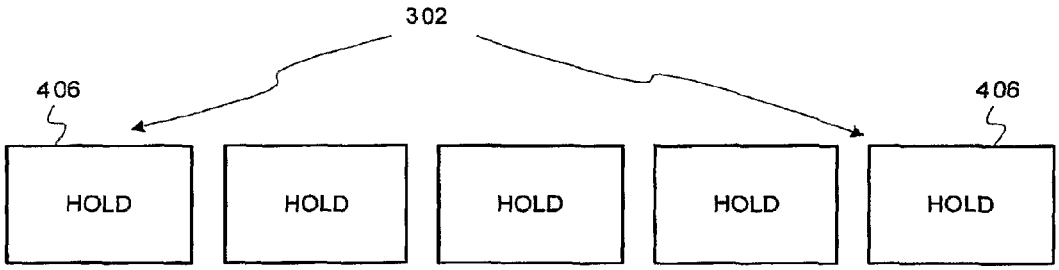
FIG. 4B shows how a wagering game machine can configure buttons to present different indicia and generate different outputs for different game types, according to embodiments of the invention.

Although not shown in FIGS. 3A-3E, each button 302 can include a variable display that can present different indicia associated with the button's different switches 310 and 312. The different indicia can indicate what inputs the button will generate when different areas of the button are pressed. FIGS. 4A and 4B describe these features in more detail.

FIG. 4A is a block diagram illustrating embodiments in which a button can present a plurality of indicia which indicate a plurality inputs generated by the button, according to example embodiments of the invention. In FIG. 4A, each button's variable display 406 is shown presenting top-area indicia 402 and bottom-area indicia 404. The top-area indicia 402 are associated with the switches 312, which are located under the top edges of the lenses 306 (see FIG. 3C). The bottom-area indicia 404 are associated with the switches 310, which are located under the bottom edges of the lenses 306 (see FIG. 3D). In one embodiment, the top-area indicia 402 describe inputs that each button will generate if the buttons' top areas are pressed. For example, if a player presses an area near the top of the leftmost button 302, the button will generate an input indicating the player wants to "play 1 line". However, if a player presses an area near the bottom of that button 302, the button 302 will generate an input indicating the player wants to "bet 1 per line".

As shown, each button 302 can be configured with different indicia and generate different input signals depending on where the button 302 is pressed. In one embodiment, wagering game machines can configure their buttons to present different indicia and generate different inputs for different game types. For example, for slots games, a wagering game machine may configure its buttons as shown in FIG. 4A. However, for poker games, the wagering game machine can configure its buttons differently.

FIG. 4B shows how a wagering game machine can configure buttons to present different indicia and generate different outputs for different game types, according to embodiments of the invention. In FIG. 4B, the buttons 302 have a different configuration from that shown in FIG. 4A. In FIG. 4B, the buttons 302 are configured for use in presenting poker games. Each button's variable display 406 is presenting textual indicia (i.e., "hold") and each button 302 is configured to generate a "hold" input when the button is pressed. As such, if players press the buttons 302, the buttons 302 will generate inputs indicating the player wants to hold certain cards in a poker game. In one embodiment, the indicia can change during different phases of a game and for bonus games. Moreover, the indicia can include text, icons, computer generated graphics, still video, streaming video, or any other suitable video content.

More Button Panels

The section continues with a discussion of FIGS. 6-15, which describe more button panels.

Figure 5:
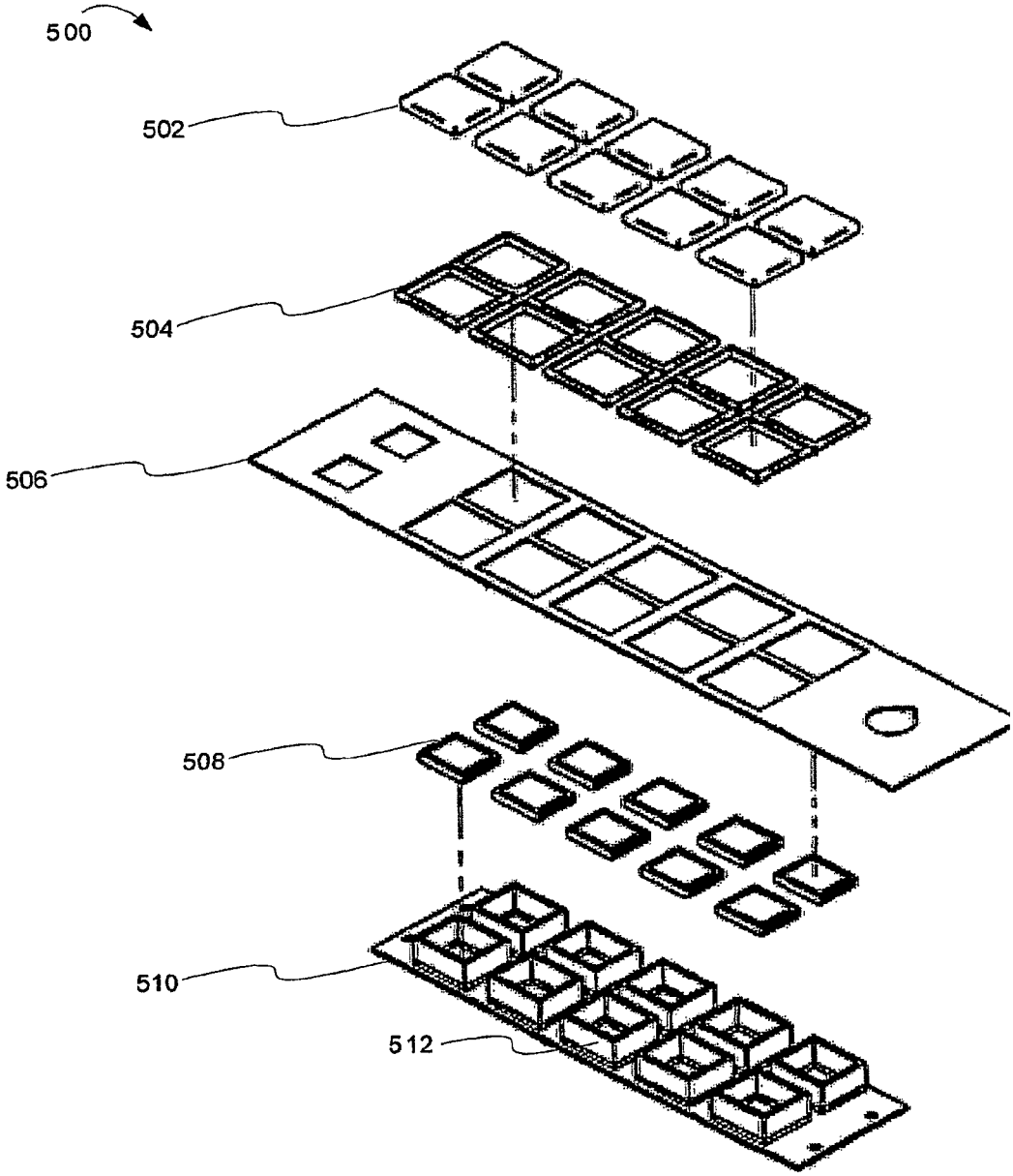
FIG. 5 is an exploded view of the wagering game machine button panel with extended sockets, according to example embodiments of the invention.

FIG. 5 is an exploded view of the wagering game machine button panel with extended sockets, according to example embodiments of the invention. The button panel 500 includes lenses 502, bezel 504, plate 506, variable displays 508, circuit board 510, and extended sockets 512. The button panel 500 is similar to the button panel 100 shown in FIG. 1. However, the extended sockets 512 differ from the sockets 112. The extended sockets 512 elevate the variable displays 508 further away from the circuit board than the sockets 112. As a result, in the button panel 500, the variable displays are held closer to the lenses than in the button panel 100.

In one embodiment, the extended sockets 512 include connectors (e.g., pins and/or sockets) for conducting power and data (e.g., display indicia) to the variable displays 508. The extended sockets 512 can also include switches that generate input signals, as described above. The variable displays 508 can include OLEDs, LCDs, or any other suitable display device.

Figure 6:
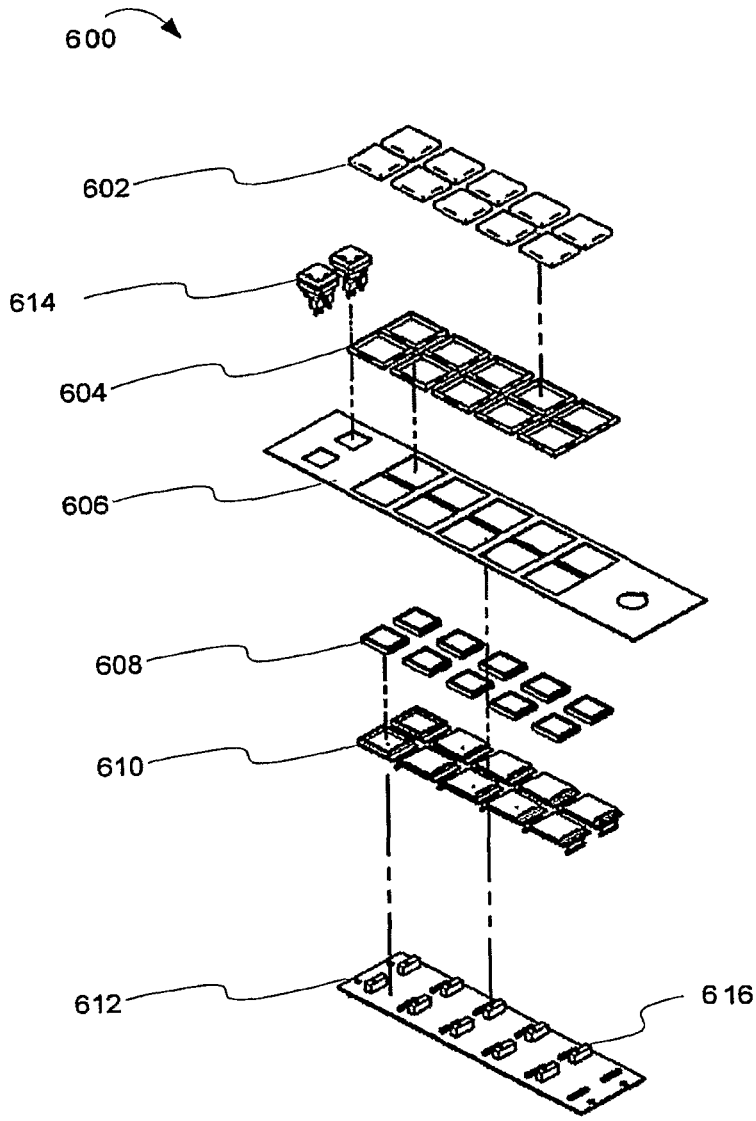
FIG. 6 is an exploded view of a wagering game machine button panel with adapter boards and variable displays, according to example embodiments of the invention.

FIG. 6 is an exploded view of a wagering game machine'button panel with adapter boards and variable displays, according to example embodiments of the invention. As shown in FIG. 6, the button panel 600 includes lenses 602, bezel 604, plate 606, variable displays 608, adapter boards 610, circuit board 612, and button devices 614.

The circuit board 612 includes connectors 616. In one embodiment, the variable displays 608 plug into the adapter boards, which in turn plug into the connectors 616. The variable displays 608 receive power and data through the connectors 616 and adapter boards 610.

This discussion continues with yet another button panel.

Figure 7A:
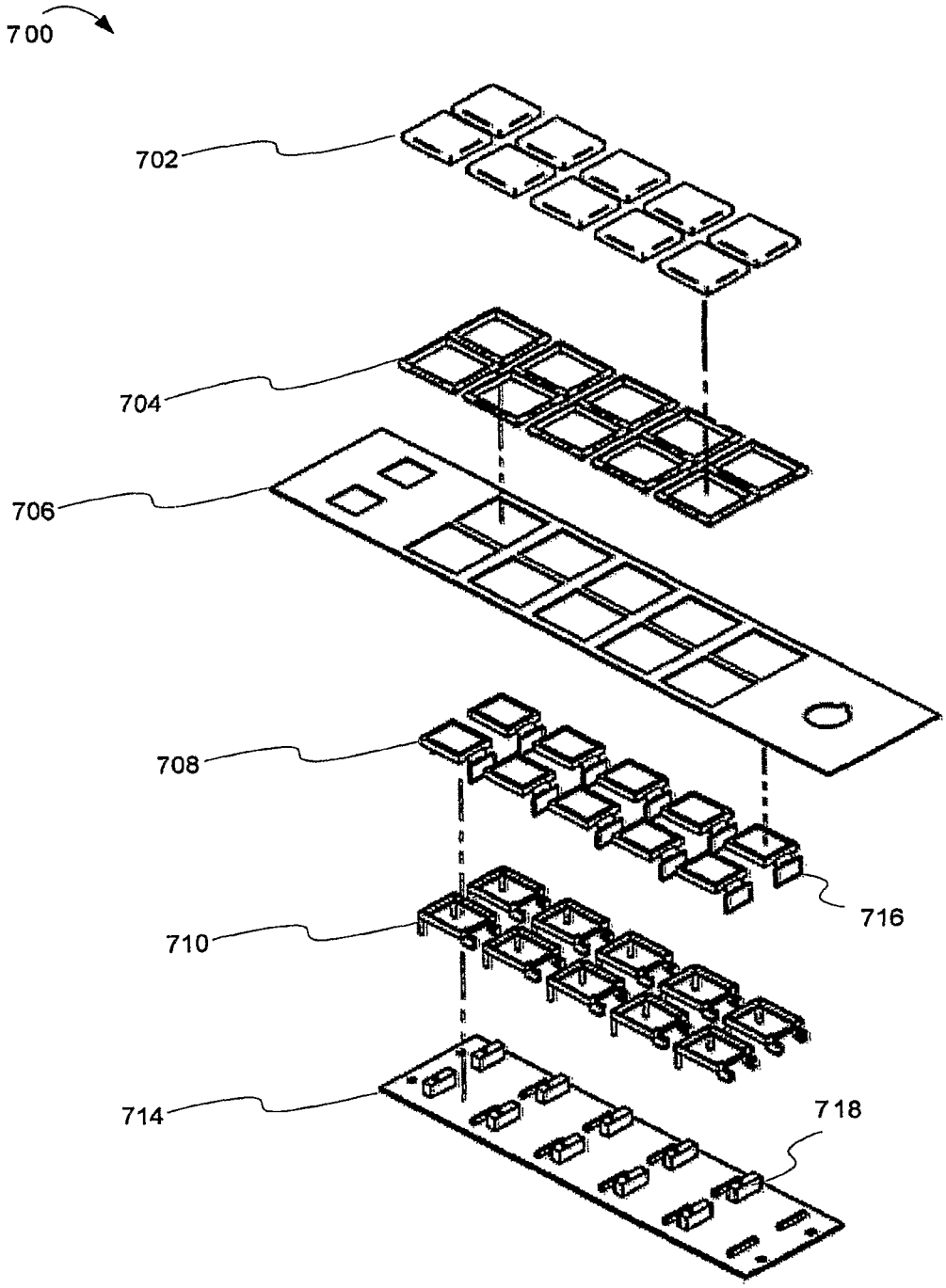
FIG. 7A is an exploded view of a button panel including variable display devices with edge connectors, according to example embodiments of the invention.
Figure 7B:
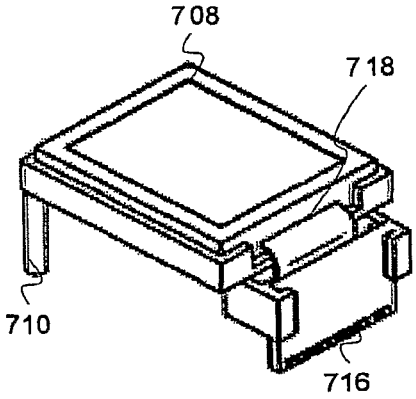
FIG. 7B is a perspective view of a variable display with edge connector and support, according to example embodiments of the invention.

FIG. 7A is an exploded view of a button panel including variable display devices with edge connectors, according to example embodiments of the invention. The button panel 700 includes lenses 702, bezels 704, and a plate 706. Additionally, the button panel 700 includes variable displays 708, supports 710, and a circuit board 714. The variable displays 708 include edge connectors 716. While the variable displays' edge connectors 716 plug into the circuit board's connectors 718, the variable displays themselves mount onto the supports 710. The circuit board 714 can also include notches, clips, or other devices for coupling to the supports 710. FIG. 7B shows more details of the variable displays 708 and supports 710.

FIG. 7B is a perspective view of a variable display with edge connector and support, according to example embodiments of the invention. In FIG. 7B, the variable display 708 includes a cable 718 connected to the edge connector 716. As shown, the variable display 708 and support 710 form a single module that can snap onto the circuit board 714, creating electrical and mechanical connections. The support 710 holds the variable display 708 above the circuit board 714 (see FIG. 7A). In one embodiment, the support 710 can include an electromagnetic shield. The variable display 708 can include an OLED, LCD, or other suitable display device.

FIGS. 8-15 illustrate other example embodiments of a button panel. FIGS. 8-15 include example embodiments of a button panel having a main button circuit board and individual display components mounted thereon. In some embodiments, a given display component is associated with a given button and may comprise an individual button display and display button circuit board. In some embodiments, the one or more switches for the button are optical, switches that are mounted on the individual display button circuit board. Accordingly, a given display button circuit board can be designed to have a specific number of switches based on the type of button. Thus, the display button circuit boards are not required to include an excess number of switches that may be unused. Moreover, as further described below, FIGS. 8-15 include example embodiments for mounting and retaining of the display components relative to the main button circuit board. Such example embodiments may provide an easier, less costly and more reliable assembly of the button panels. As further described below, once assembled onto main button circuit board, the actuator/spring assemblies provide assembly guidance of the display components above the main button circuit board. Moreover, the actuator/spring assemblies are used for retaining the display components relative to the main button circuit board.

Figure 8:
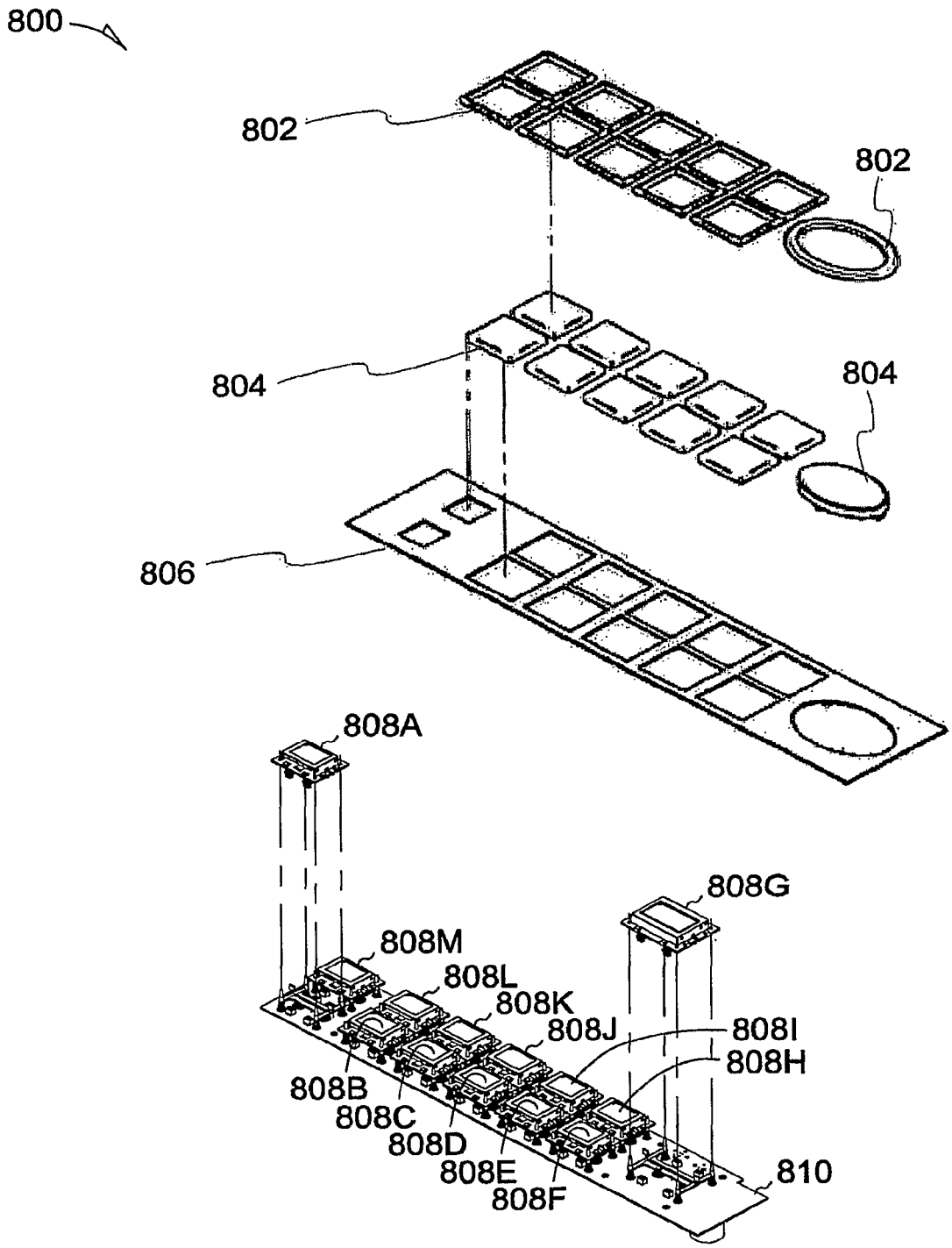
FIG. 8 is an exploded view of a button panel including individual display circuit boards for the buttons, according to example embodiments of the invention.
Figures 9A, 9B, 9C, 9D:
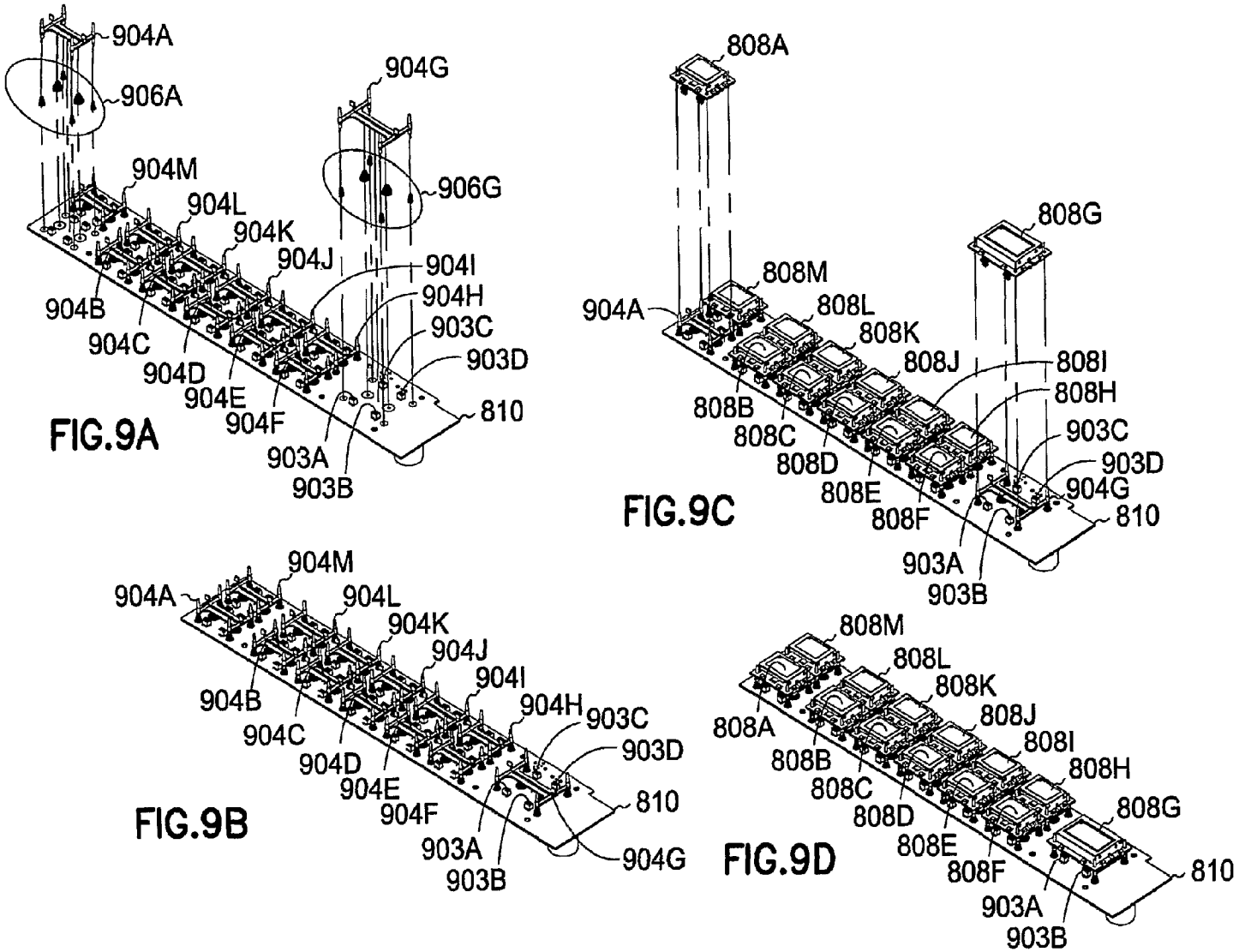
FIGS. 9A-9D are exploded views of the display components for buttons that are mounted on a main button circuit board, according to example embodiments of the invention.

FIG. 8 is an exploded view of a button panel including individual display circuit boards for the buttons, according to example embodiments of the invention. The button panel 800 includes lenses 804, bezel 802, plate 806, display components 808A-808M and main button circuit board 810. The button panel 800 is similar to the button panel 100 shown in FIG. 1. However, (as further described below) a display component 808 includes a variable display and a display circuit board. The display circuit boards includes one or more switches. In some embodiments of this configuration, the switches are not mounted on the main button circuit board. As further described below, an actuator and a number of springs are used to assist in mounting the display components 808 to the main button circuit board 810. The variable displays can include OLEDs, LCDs, or any other suitable display device.

FIGS. 9A-9D are exploded views of the display components for buttons that are mounted on a main button circuit board, according to example embodiments of the invention. FIGS. 9A-9D illustrate a main button circuit board 810, a number of actuators 904A-904M, a number of springs 906 and a number of display components 808A-808M. The main button circuit board 810 includes sockets 903A-903D that are to used to couple to the display components 808G using one or more connector pins that extend down from the display circuit board. As shown, the main circuit board comprises a number of other sockets (e.g., four per display component) for connecting the display circuit board to the main button circuit board 810. However, for sake of clarity even though illustrated, each of these sockets for the different display circuit boards are not labeled. In some embodiments, the display circuit board may comprise four connector pins that are mounted onto four sockets on the main button circuit board 810. The legs of the actuators 904 extend through holes of the display circuit boards. The bottom of the legs of the actuators 904 extend through the springs 906 such that the springs 906 are positioned between the display circuit boards and the main button circuit board 810. As shown, a given display component 808A-808M is mounted on an actuator 904 that is mounted on one or more springs 906, which are used to assist in mounting the display component 808 onto the main button circuit board 810 (as is now described).

Figure 10A:
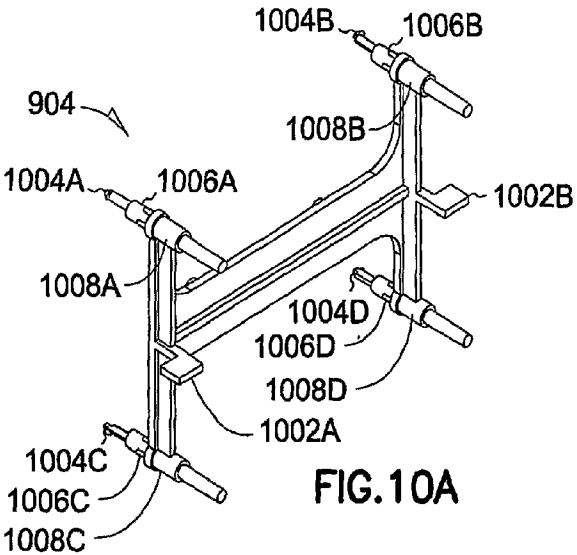
FIGS. 10A-10E illustrate different views of an actuator, according to example embodiments of the invention.
Figure 10B:
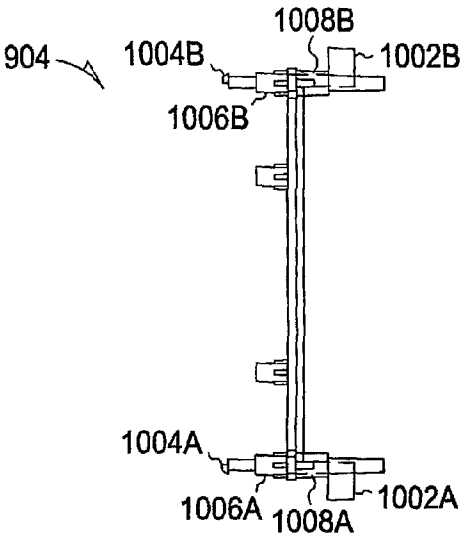
Figure 10C:
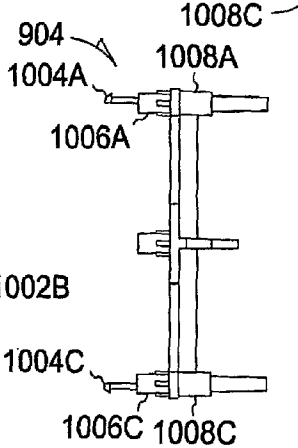
Figure 10E:
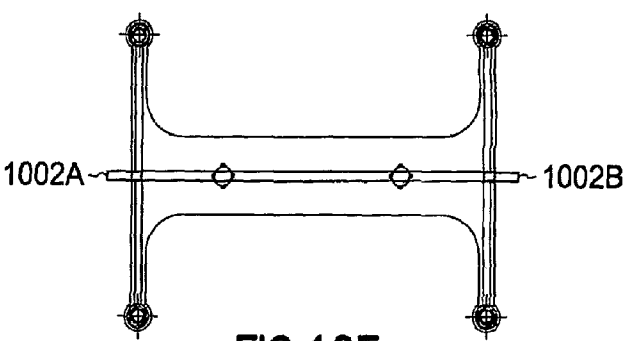
Figure 10D:
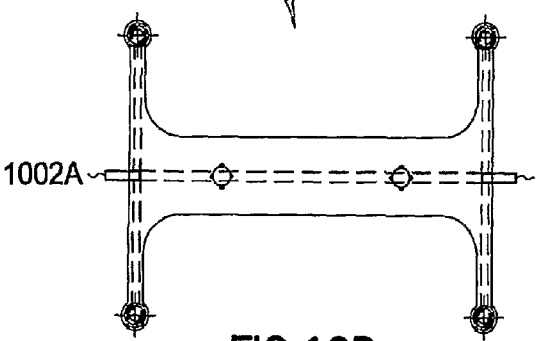

FIGS. 10A-10E illustrate different views of an actuator, according to example embodiments of the invention. FIG. 10A illustrates a perspective view of an actuator 904. FIG. 10B illustrates a first side view of the actuator 904. FIG. 10C illustrates a second side view of the actuator 904. FIG. 10D illustrates a bottom view of the actuator 904. FIG. 10E illustrates a top view of the actuator 904. The actuator 904 includes two tab flags 1002A-1002B that are used for optical switching as further described below. The actuator 904 also includes separate upward and downward travel limiting elements along its legs. The legs of the actuator 904 include retention clips 1004A-1004D for limiting upward travel. The retention clips 1004 are configured to maintain an upward location that properly positions the tab flags 1002 relative to the switches for the optical switching (as further described below). Also, the retention clips 1004A-1004D preclude sections 1008A-1008D along the legs of the actuator 904 from pressing upward against the display circuit board. This configuration precludes the return force from an actuation from dislodging (over time) the display circuit board after numerous actuations. The legs of the actuator 904 also includes sections 1006A-1006D to limit downward travel. The sections 1006 stops against the main button circuit board 810. Each of the sections 1006 also include a number of ribs (e.g., four) that retain the springs in a given position relative to the main button circuit board 810 and the display circuit board. The number of ribs may press-fit into the top coil of the spring.

Figure 14A:
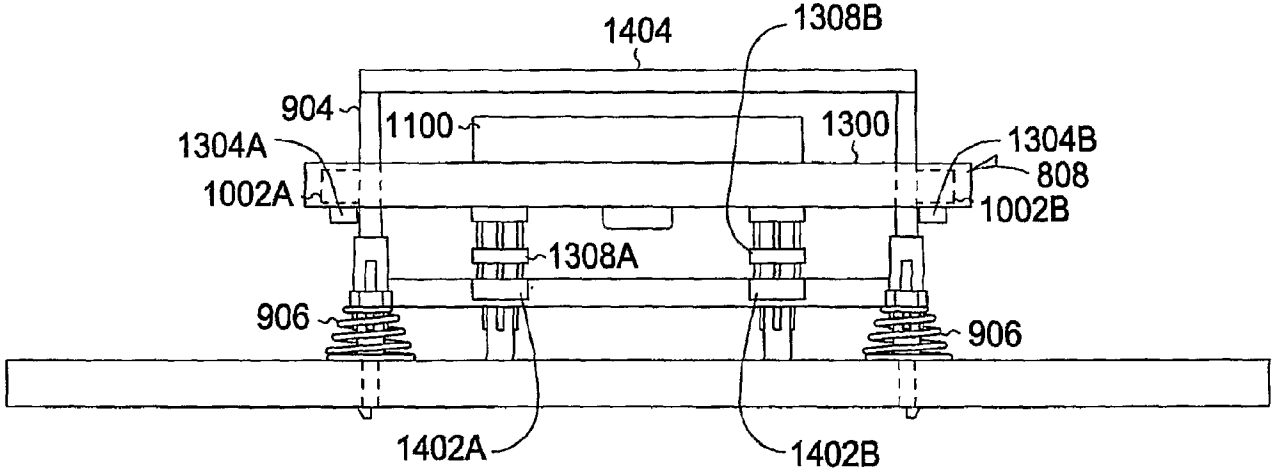
FIGS. 14A-14B illustrate side views of the operation of the actuator relative to the display component and the main button circuit board, according to example embodiments of the invention.
Figure 14B:
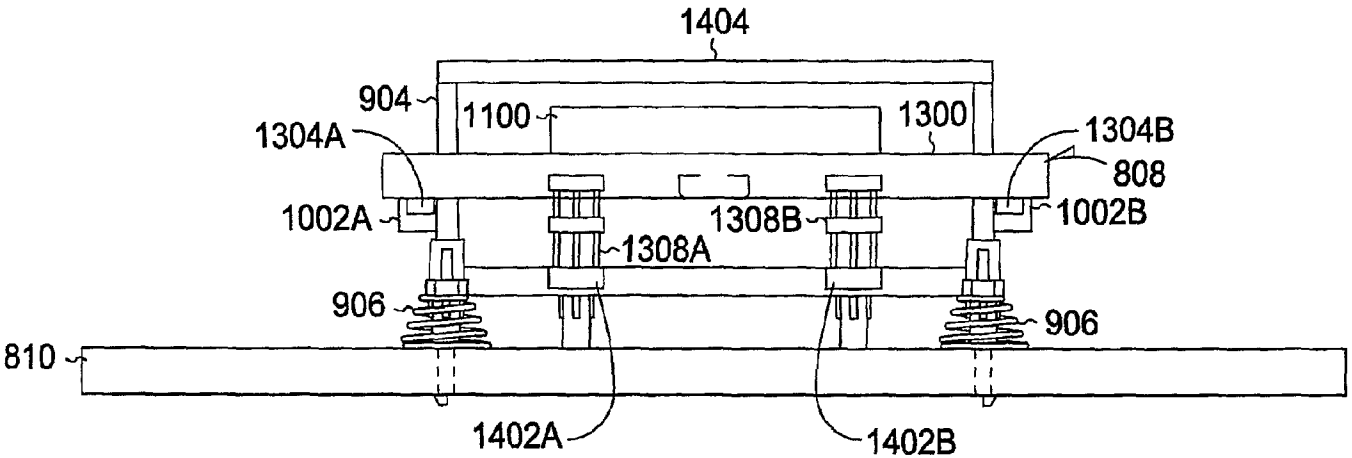

Once snapped into position on the main button circuit board 810, the actuator 904 and the springs 906 are retained and are used to assist in the assembly of the display circuit board to the main button circuit board 810. Specifically, the upper part of the legs of the actuator 904 provide assembly guidance for the positioning of the display circuit board above the main button circuit board 810. With the actuator 904 in position, the display circuit board is aligned with the legs of the actuator 904 such that the connector pins of the display circuit board are in alignment with the associated sockets on the main button circuit board 810 (for what may be considered an essentially blind assembly). A more detailed illustration of the display circuit board, actuator, springs and main button circuit board assembled together is shown in FIGS. 14A-14B (which is described in more detail below).

Figure 11A:
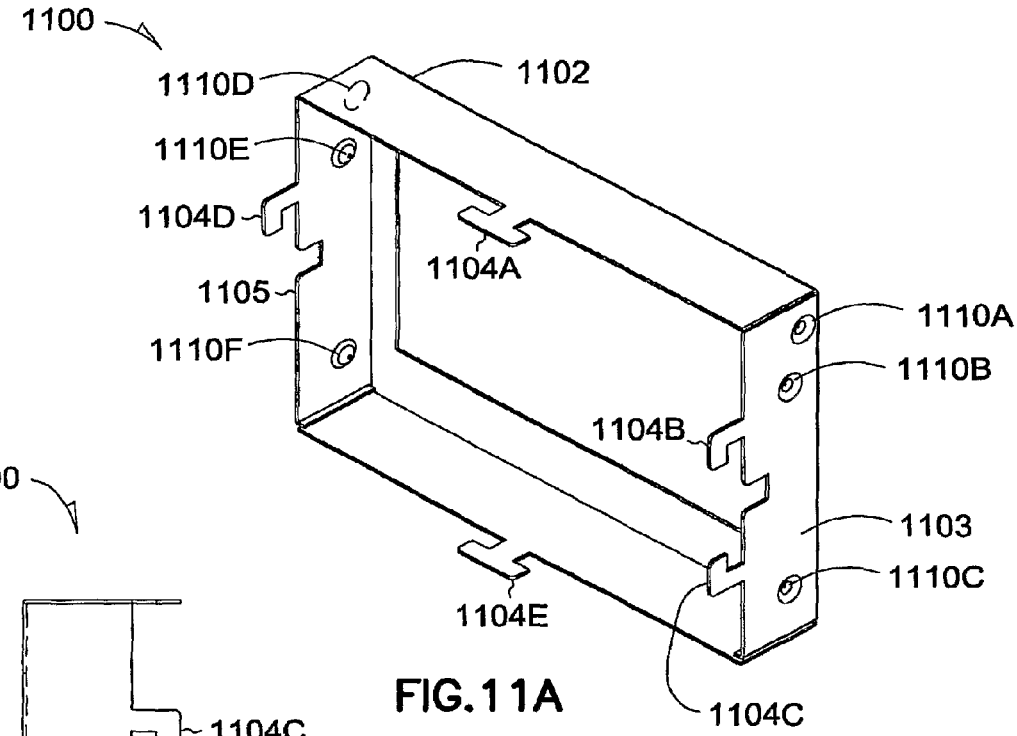
FIGS. 11A-11C illustrate different views of a display housing, according to example embodiments of the invention.
Figure 11C:
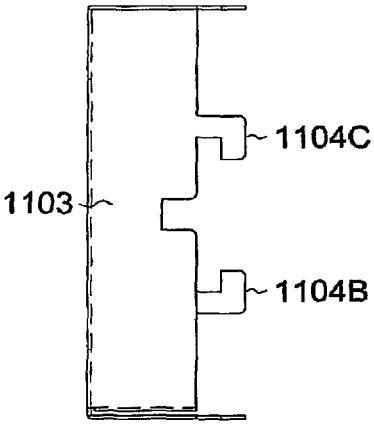
Figure 11B:
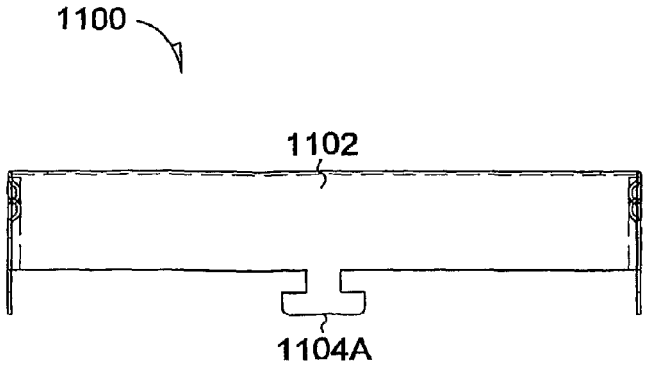

FIGS. 11A-11C illustrate different views of a display housing, according to example embodiments of the invention. FIG. 11A illustrates a perspective view of a display housing 1100. FIG. 11B illustrates a first side view of the display housing 1100. In particular, FIG. 11B illustrates a more detailed view of a wall 1102 of the display housing 1100. FIG. 11C illustrates a second side view of the display housing 1100. In particular, FIG. 11C illustrates a more detailed view of a wall of the display housing 1100. The display housing 1100 comprises tabs 1104A-1104E and dimples 1110A-1110F. As further described below, the tabs 1104A-1104E are used to secure the variable display (mounted in the display housing 1100) to the display circuit board. As shown, the tabs 1104 are asymmetric for purposes of orientation. In particular, the wall 1105 includes one tab (tab 1104D), while the wall 1103 includes two tabs (tabs 1104B-1104C). Accordingly, mounting of the display housing 1100 onto the display circuit board is more easily performed during the assembly process. In some embodiments, the tabs 1104 are twisted once the tabs are passed through the corresponding slots in the display circuit board (see FIGS. 13A-13C described below). Alternatively or in addition, the tabs 1104 may be formed such that the tabs 1104 yield upon insertion into the slots of the display circuit board and release once the tabs 1104 have passed through the slots. Alternatively or in addition to the tabs 1104, the display housing 1100 may be secured to the display circuit board by soldering the two components together, by screws, by rivets, etc.

The dimples 1110A-1110F are used to securely position the display within the display housing 1100. As shown, the wall 1103 and the wall 1105 include three dimples 1110A-1110C and three dimples 1110D-1110F, respectively. The first pair of dimples 1110B-1110C and the second pair of dimples 1110E-1110F retain the display in an upward location in the display housing 1100. The dimple 1110A and the dimple 1110D maintain the display biased toward a wall 1107 of the display housing 1100.

Figure 12A:
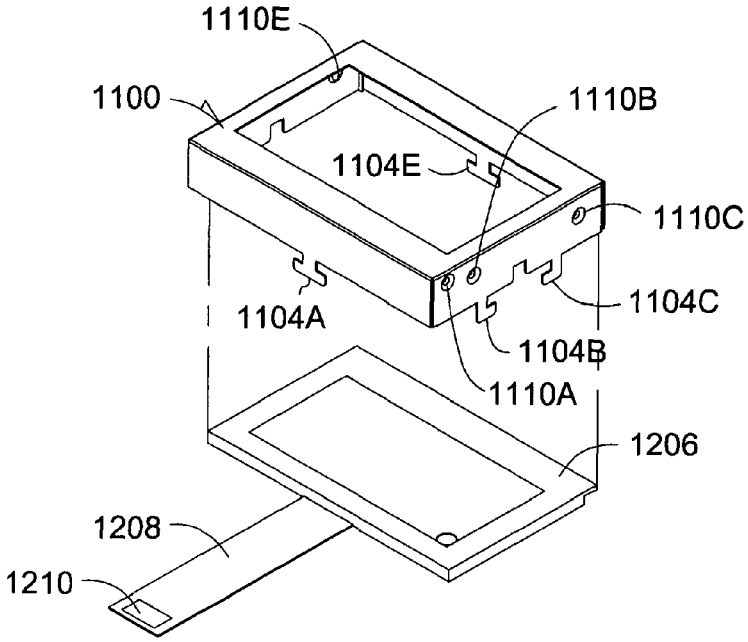
FIG. 12A illustrates an assembly sequence for the display and display housing, according to example embodiments of the invention.
Figure 12B:
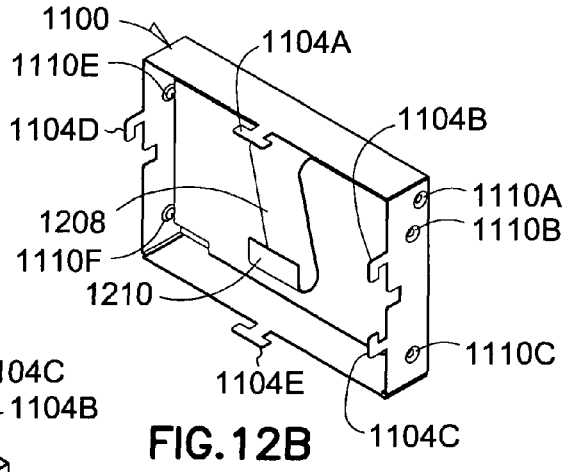
FIGS. 12B-12C illustrate perspective views of the assembled display and display housing, according to example embodiments of the invention.
Figure 12C:
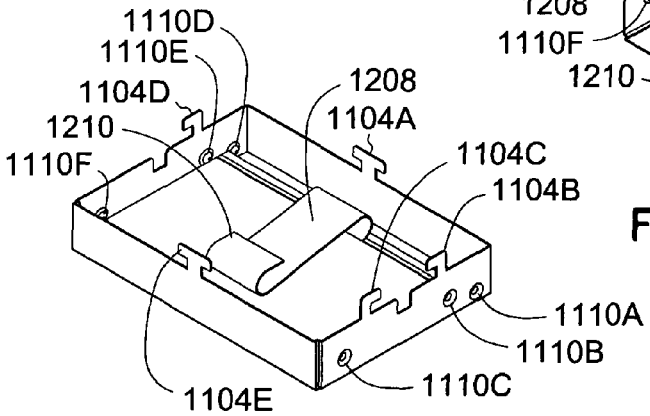

FIG. 12A illustrates an assembly sequence for the display and display housing, according to example embodiments of the invention. FIGS. 12B-12C illustrate perspective views of the assembled display and display lousing, according to example embodiments of the invention. FIGS. 12A-12C illustrate a display housing 1100 and a display 1206. The display housing 1100 comprises a number of dimples 1110A-1110F. The display 1206 includes a cable 1208 having a connector 1210 that is used to electrically couple the display 1206 to a display circuit board (further described below). The connector 1210 may be used to couple the display 1206 to the display circuit board both mechanically and electrically. The connector 1210 may be used to electrically couple the display 1206 to the display circuit board. Thus, the display 1206 is fixed in space within the display housing 1100. In particular, the dimples 1110A-1110F are used to snap and secure the display 1206 into the display housing 1100.

The display housing 1100 enables the display 1206 to be in a suspended fixed position relative to the display circuit board. Accordingly, the display 1206 is essentially fixed in an X, Y and Z position by the display housing 1100. As shown, this configuration allows for a compact footprint for the display and display circuit board that includes control circuitry thereon. In some embodiments, all or at least a part of the display housing 1100 is metallic. Accordingly, the display housing 1100 may be used as an effective ground path from the display 1206 to the display circuit board. The display housing 1100 may be formed from any type of metallic material (such as beryllium copper, etc.). In some embodiments, the display housing 1100 may be a plastic wherein all or parts of the plastic include a conductive coating.

The lenses are above the display components 808 and are'positioned on top of the actuators. The lenses are resting or setting on top of the actuators (and not physically attached). Embodiments allow the lens to be closer to the display components because the tolerances may be smaller. Specifically, because the display components 808 are essentially at a fixed position in the Z direction, the lens may be positioned closer to the display components 808.

Figure 13A:
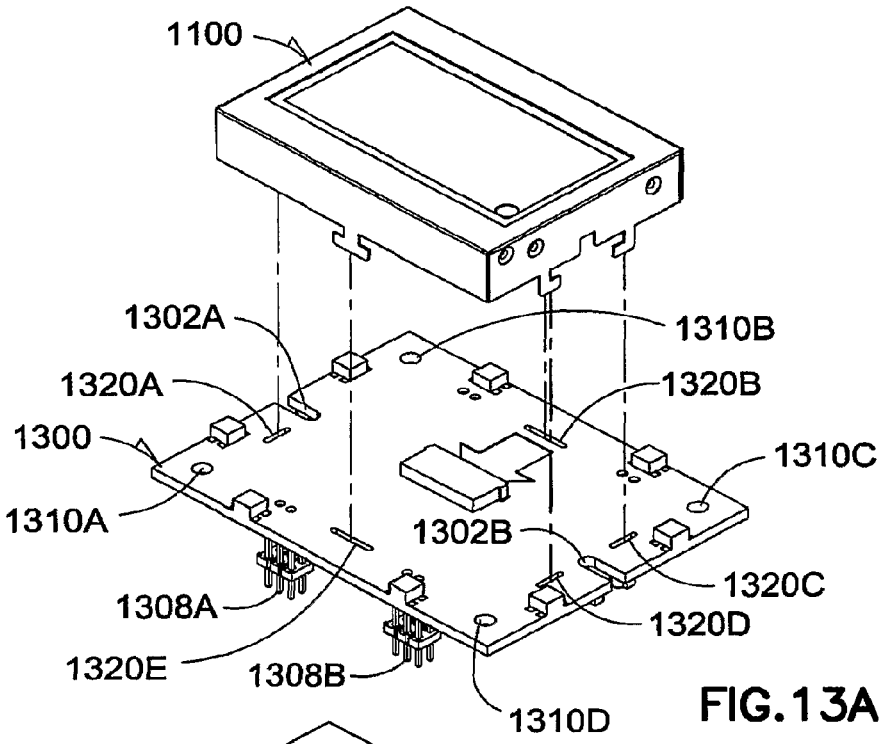
FIGS. 13A-13C illustrate perspective views of a display circuit board that is part of a display component, according to example embodiments of the invention.
Figure 13B:
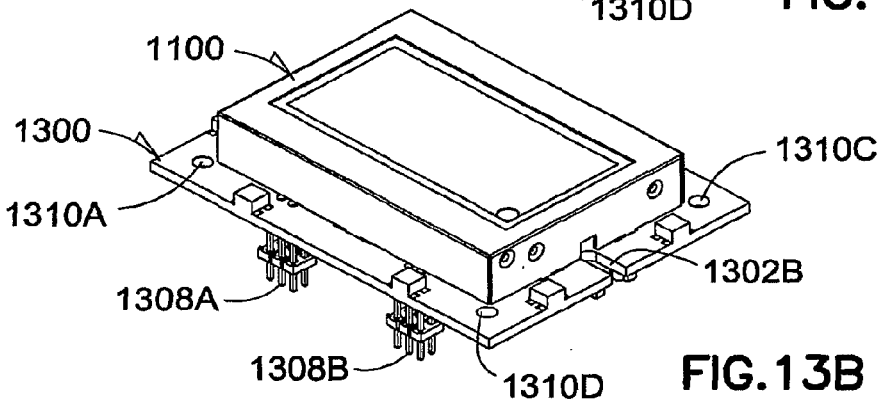
Figure 13C:
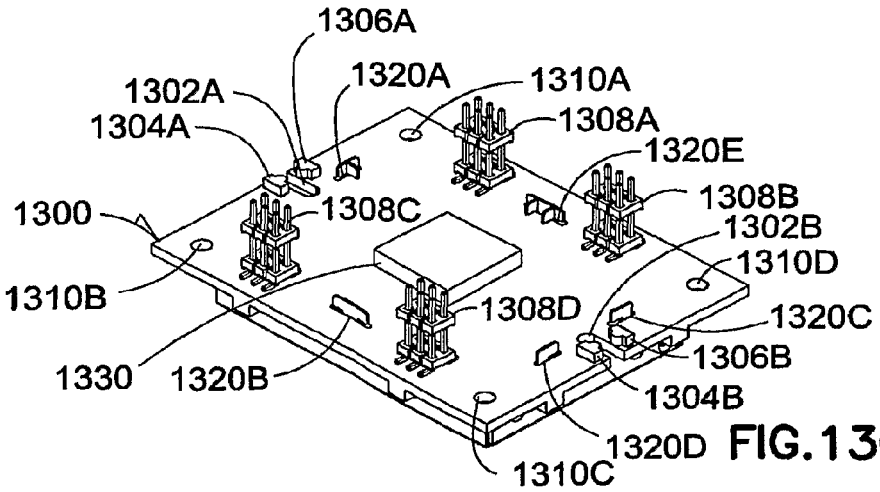

FIGS. 13A-13C illustrate perspective views of a display, circuit board that is part of a display component, according to example embodiments of the invention. FIG. 13A illustrates a perspective view of the top side of a display circuit board 1300 prior to coupling the display housing 1100 to the display circuit board 1300. FIG. 13B illustrates a perspective view of the top side of a display circuit board 1300 after coupling the display housing 1100 to the display circuit board 1300. FIG. 13C illustrates a perspective view of the bottom side of the display circuit board 1300. The display circuit board 1300 includes a processor component 1330 and two optical switches (each of which are comprised of a light source and a light receiver). A first optical switch includes a light source 1304A and a light receiver 1306A (which are mounted on the bottom side of the display circuit board 1300). A second optical switch includes a light source 1304B and a light receiver 1306B (which are mounted on the bottom side of the display circuit board 1300). The display circuit board 1300 also includes openings 1320A-1320E, which are used to receive tabs 1104A-1104E of the display housing 1100 to securely position the display housing 1100 to the display circuit board 1300. The display circuit board 1300 also includes openings 1302A-1302B, which the tab flags 1002 of the actuator 904 move within during a button press. This operation of the tab flags 1002 of the actuator 904 is described in more detail below. The display circuit board 1300 also includes holes 1310A-1310D. As further described below, the legs of the actuator 904 extend through the holes 1310A-1310D.

The display circuit board 1300 also includes connector pins 1308A-1308D, which are used to secure the display circuit board 1300 to the main button circuit board 810. In some embodiments, the distances between pairs of connector pins 1308 are asymmetric. As show in FIG. 13C, a first pair of connector pins includes connector pin 1308A and connector pin 1308B, which are on one side of the display circuit board 1300. A second pair includes connector pin 1308C and connector pin 1308D, which are on an opposite side of the side of the first pair. The distance between the connector pin 1308A and the connector pin 1308B is different than the distance between the connector pin 1308C and the connector pin 1308D. Accordingly, the display circuit board 1300 cannot be assembled incorrectly (e.g., upside down).

FIGS. 14A-14B illustrate side views of the operation of the actuator relative to the display component and the main button circuit board, according to example embodiments of the invention. FIG. 14A and FIG. 14B illustrate side views while button is not being pressed and is being pressed, respectively. FIGS. 14A-14B illustrate a main button circuit board 810. The legs of the actuator 904 are snapped into holes of the main button circuit board 810 (through the springs 906). Thus, the springs 906 are retained by the legs of the actuator 904 after being snapped into the holes of the main button circuit board 810. A display component 808 comprises a display circuit board 1300 and a display housing 1100. Connector pins 1308A-1308B that are part of the display circuit board 1300 extend down and are plugged into sockets 1402A-1402B, respectively, on the main button circuit board 810. The legs of the actuator 904 extend through holes of the display circuit board 1300. A lens 1404 is positioned on top of the legs of the actuator 904. When the button panel is mounted in a wagering game machine, players can press the buttons by applying pressure to the lens 1408. This pressure causes the actuator 904 to move downward and compress the springs 906.

The actuator 904 includes tab flags 1002A-1002B. As shown in FIG. 14A, the tab flags 1002A-1002B are positioned above the bottom surface of the display circuit board 1300. The bottom side of display circuit board 1300 includes the light source 1304A for a first optical switch and the light source 1304B for a second optical switch. The light receiver 1306A (not shown) is on the opposite side of the tab flag 1002A. The light receiver 1306B (not shown) is on the opposite side of the tab flag 1002B. In some embodiments, a light source and a light receiver are an optical switch for the button. FIG. 14B illustrates the side view while the button is being pressed. As shown, the tab flags 1002A-1002B are moved through slots of the display circuit board 1300 and below the bottom side of the display circuit board 1300, during the button actuation. Accordingly, light from the light source to be received by the associated light receiver is blocked by the tab flag 1002 (thus indicating a button actuation). As shown, the switches are positioned on the display circuit board 1300. Accordingly, the display circuit boards 1300 can include a configurable number of switches, depending on the type of button (one-switch, two-switch, four-switch, etc.). Therefore, the display circuit board is not required to include an excess number of switches that may be unused.

Figure 15:
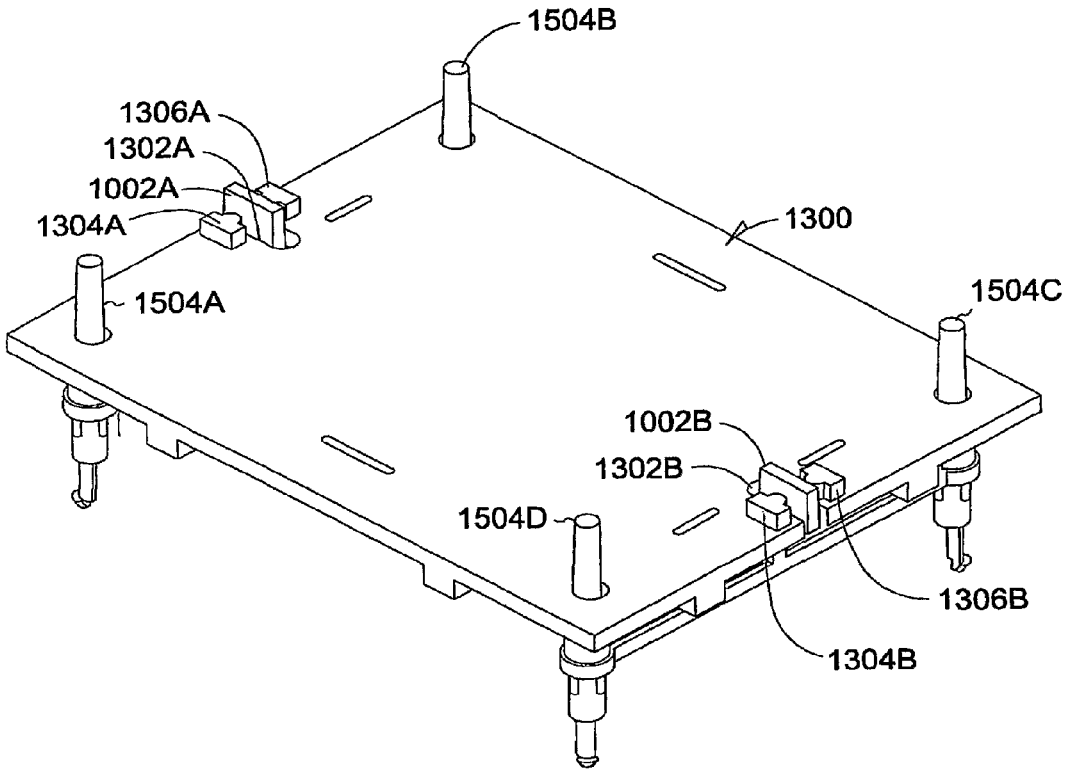
FIG. 15 illustrates a perspective view of an optical switch for a button for a wagering game machine on a display circuit board, according to example embodiments of the invention.

To better illustrate the optical switching, FIG. 15 illustrates a perspective view of an optical switch for a button for a wagering game machine on a display circuit board, according to example embodiments of the invention. FIG. 15 illustrates a bottom surface of the display circuit board 1300 and parts of an actuator 904. Specifically, the actuator 904 includes legs 1504A-1504D and tab flags 1002A-1002B. The legs 1504 extend through holes of the display circuit board 1300. During a button press (actuation), the tab flags 1002A-1002B are positioned in openings 1302A and 1302B, respectively, and below the bottom surface of the display circuit board 1300. The display circuit board 1300 includes two optical switches. A first optical switch includes the light source 1304A and the light receiver 1306A, used in conjunction with the tab flag 1002A. A second optical switch includes the light source 1304B and a light receiver 1306B, used in conjunction with the tab flag 1002B. In some embodiments, the light sources 1304 may be light emitting diodes. In some embodiments, the light receivers 1306 may be phototransistors.

The light source 1304A emits a light that is to be received by the light receiver 1306A. While the button is being pressed, the light is block by the tab flag 1002A. While the button is not being pressed, the light is not block by the tab flag 1002A and is received by the light receiver 1306A. In particular during a button press (actuation), the tab flag 1002A is moved through the opening 1302A. Accordingly, the tab flag 1002A is blocking the light. Similarly, the light source 1304B emits a light that is to be received by the light receiver 1306B. While the button is being pressed, the light is block by the tab flag 1002B. While the button is not being pressed, the light is not block by the tab flag 1002B and is received by the light receiver 1306B. In particular, the tab flag 1002B is moved through the opening 1302B. Accordingly, the tab flag 1506B is blocking the light. A processor component (such as a microcontroller) may be on the display circuit board 1300. The processor component may be coupled to the light sources 1304 and the light receivers 1306. While the button is being pressed, the light receivers 1306 may transmit an indication to the processor component that the button is being pressed. This actuation indication may be transmitted to the main button circuit board and forward to the processor unit of the wagering game machine to process the button actuation. In some embodiments, the light sources may only emit light during selective periods of operation. For example, if the wagering game machine is in a state where the button could not be pressed or actuated, the light sources do not emit light. Accordingly, a false button actuation does not occur during this period.

This description will continue with a discussion of example wagering game architectures in which the above-described button panels can be used. Operations performed by the architectures will also be described below.

Wagering Game Machine Architecture

Figure 16:
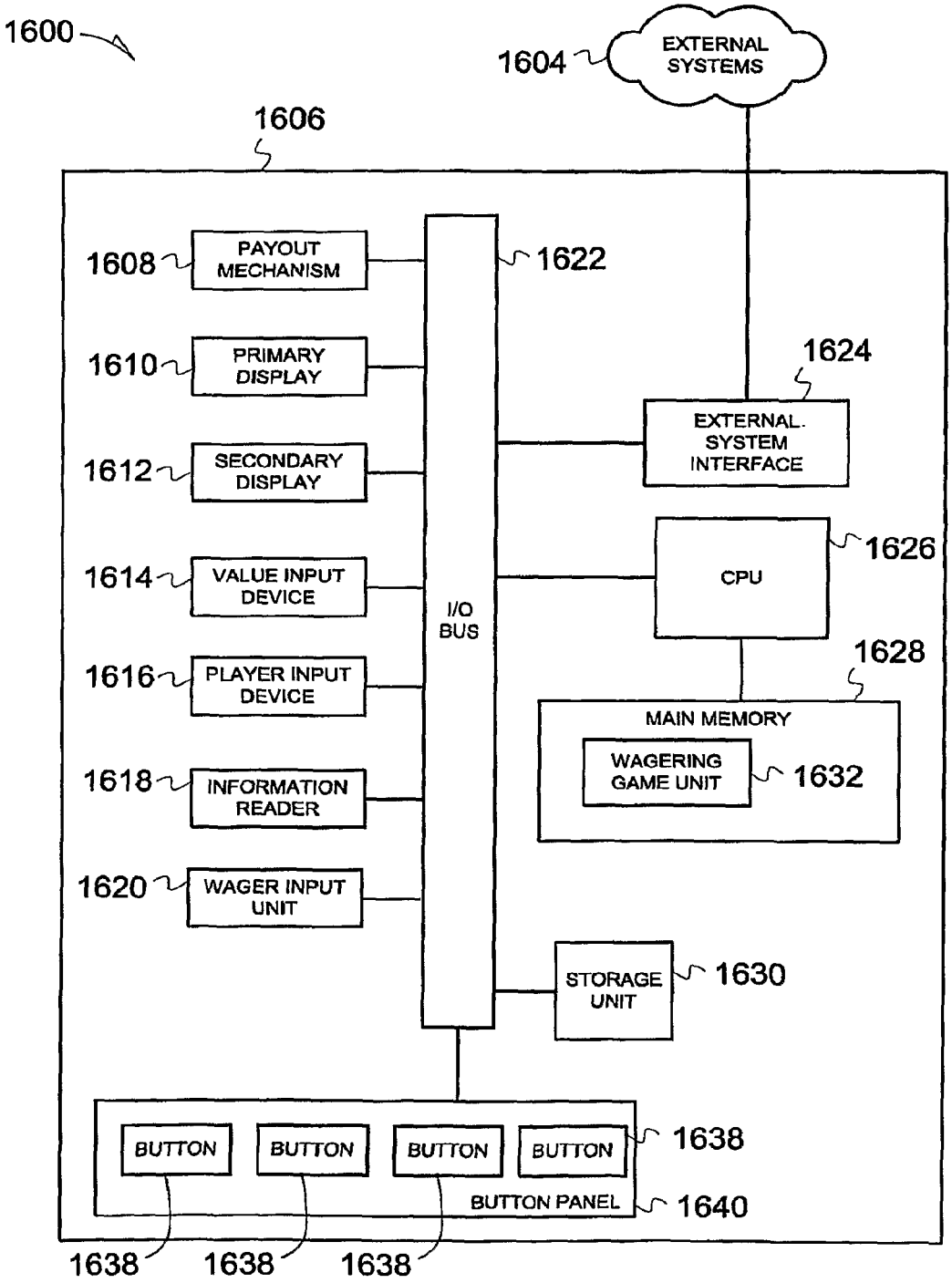
FIG. 16 is a block diagram illustrating a wagering game machine architecture, according to example embodiments of the invention.

FIG. 16 is a block diagram illustrating a wagering game machine architecture, according to example embodiments of the invention. In FIG. 16, the wagering game machine architecture 1600 includes a wagering game machine 1606. The wagering game machine 1606 includes a central processing unit (CPU) 1626 connected to main memory 1628, which includes a wagering game unit 1632. In one embodiment, the wagering game unit 1632 can present wagering games, such as video poker, video black jack, video slots, video lottery, etc., in whole or part.

The CPU 1626 is also connected to an input/output (I/O) bus 1622, which facilitates communication between the wagering game machine's components. The I/O bus 1622 is connected to a payout mechanism 1608, primary display 1610, secondary display 1612, value input device 1614, player input device 1616, information reader 1618, and storage unit 1630. The player input device 1616 can include the value input device 1614 to the extent the player input device 1616 is used to place wagers. The I/O bus 1622 is also connected to an external system interface 1624, which is connected to external systems 1604 (e.g., wagering game networks).

The wagering game machine 1606 also includes a button panel 1640 that includes a plurality of buttons 1638. When pressed, the buttons 1638 can generate input signals used by the wagering game unit 1632 in presenting wagering games. Although not shown in FIG. 16, each button 1638 can include one or more switches, variable displays, support mechanisms, adapter boards, sockets, and/or other components. Additionally, the button panel 1640 can include lenses, bezels, plates, and other components. As described above, each button 1638 can present indicia on different areas of the button, where the indicia indicate input signals that will be generated when different areas of the button are pressed. In some embodiments, the wagering game unit 1632 configures the button panel 1640 based on the type of games being presented. For example, the wagering game unit 1632 can configure the buttons 1638 with one set of indicia for slots games and different sets of indicia for poker, blackjack, and other games. Operations for configuring the button panel 1640 are described below, in the next section.

In one embodiment, any of the components of the wagering game machine 1606 (e.g., the wagering game unit 1632) can include hardware, firmware, and/or machine readable media including instructions for performing the operations described herein. Machine-readable media includes any mechanism that provides (i.e., stores and/or transmits) information in a form readable by a machine (e.g., a wagering game machine, processor, etc.). For example, tangible machine-readable media includes read only memory (ROM), random access memory (RAM), magnetic disk storage media, optical storage media, flash memory machines, etc. Machine-readable media also includes any media suitable for transmitting software over a network. Furthermore, in some embodiments, the components of the wagering game machine 1606 can be interconnected according to any suitable interconnection architecture (e.g., directly connected, hypercube, etc.).

Example Operations

This section describes operations performed by some embodiments of the invention. In the discussion below, the flow diagrams will be described with reference to the Figures presented above. In certain embodiments, the operations are performed by executing instructions residing on machine-readable media (e.g., software), while in other embodiments, the operations are performed by hardware and/or other logic (e.g., firmware). In some embodiments, the operations are performed in series, while in other embodiments, one or more of the operations can be performed in parallel.

Figure 17:
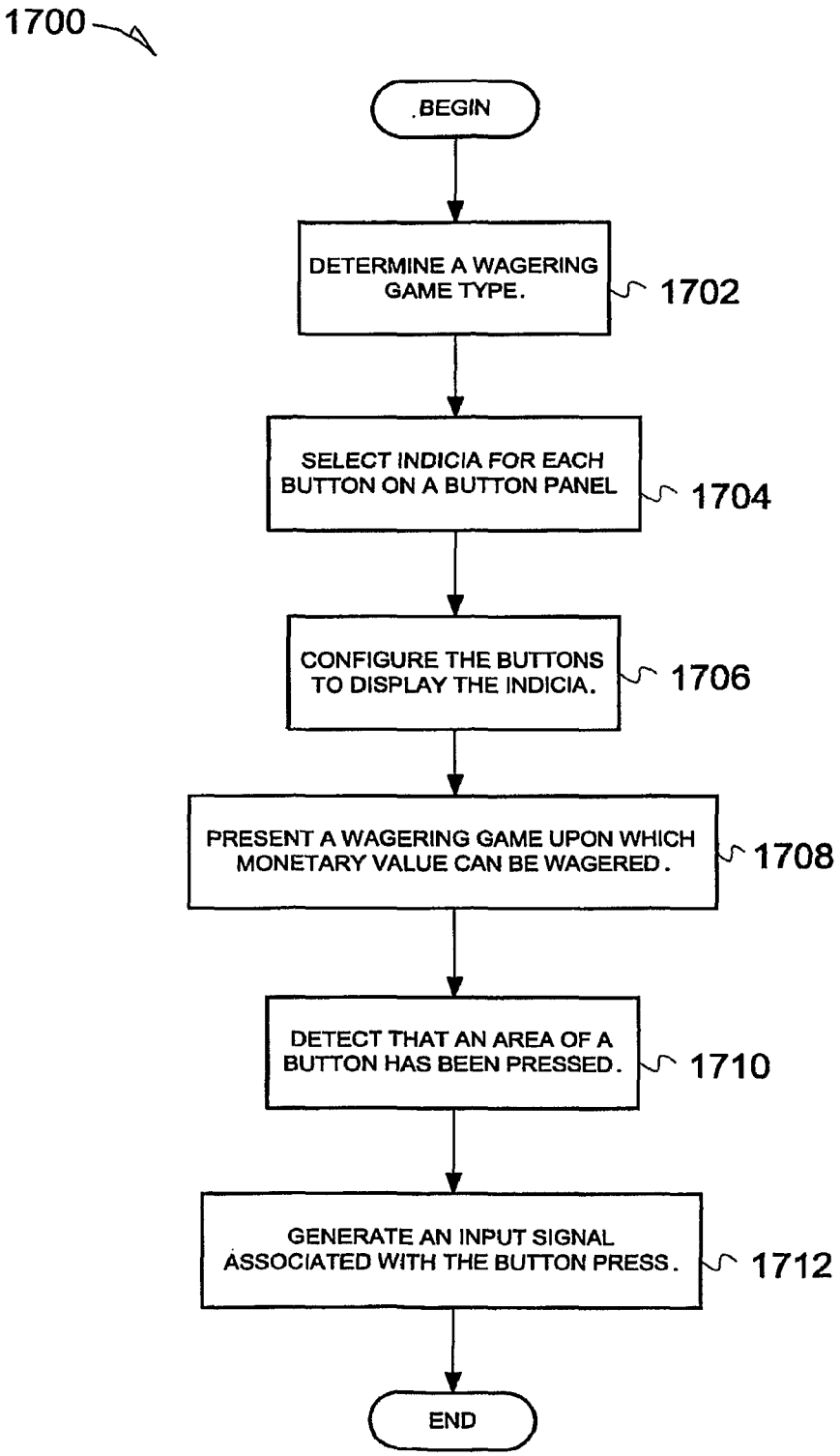
FIG. 17 is a flow diagram illustrating operations for configuring buttons to generate different inputs based on where the buttons are pressed, according to example embodiments of the invention.

FIG. 17 is a flow diagram illustrating operations for configuring buttons to generate different inputs based on where the buttons are pressed, according to example embodiments of the invention. The flow diagram 1700 begins at block 1702.

At block 1702, a wagering game type is determined. For example, the wagering game unit 1632 determines a type of wagering game based on an input received from the buttons 1638. In some embodiments, the wagering game types include slots, blackjack, poker, roulette, etc. The flow continues at block 1704.

At block 1704, indicia for each button are selected. For example, the wagering game unit 1632 selects indicia associated with the selected wagering game type. In one embodiment, the indicia include data indicating where on the buttons 1638 the indicia will be displayed. Indicia can include text, icons, streaming video, etc. The flow continues at block 1706.

At block 1706, the buttons are configured to display the indicia. For example, the wagering game unit 1632 transmits the indicia to the buttons 1638. In one embodiment, the indicia are stored in the buttons themselves, while in other embodiments, the indicia are stored in media associated with the button panel 1640. Each button's variable display displays the indicia. See FIGS. 4A and 4B for an example of how embodiments may display the indicia. The flow continues at block 1708.

At block 1708, a wagering game is presented. For example, the wagering game unit 1632 presents a wagering game (e.g., slots, blackjack, poker, etc.) upon which monetary value can be wagered. The flow continues at block 1710.

At block 1710, a determination is made that an area of a button has been pressed. For example, a button 1638 determines that a particular area has been pressed. In one embodiment, the button makes this determination based on which of its switches have been actuated. The flow continues at block 1712.

At block 1712, an input signal is generated. For example, the button 1638 generates an input signal associated with switches that have been actuated. In one embodiment, the button 1638 transmits the input signal to the wagering game unit 1632 for use in association with the wagering game. The input signal can indicate that a player wants to bet, manipulate game elements, cash-out, etc. From block 1712, the flow ends.

Wagering Game Machines and Networks

This section describes wagering game machines and wagering game networks with which embodiments of the invention can be used.

Wagering Game Machines

Figure 18:
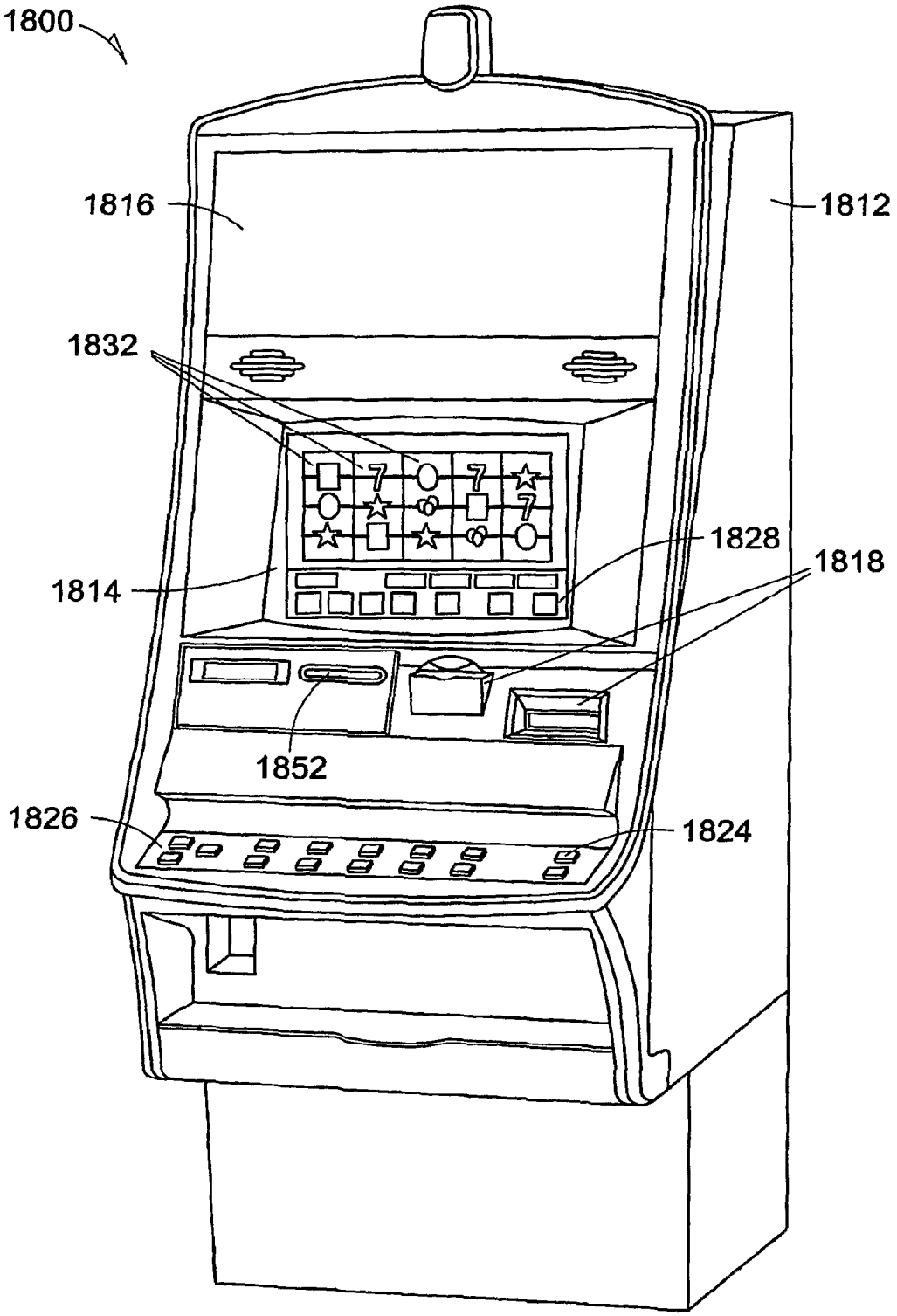
FIG. 18 is a perspective view of a wagering game machine, according to example embodiments of the invention.

FIG. 18 is a perspective view of a wagering game machine, according to example embodiments of the invention. Referring to FIG. 18, a wagering game machine 1800 can be used in gaming establishments, such as casinos. According to embodiments, the wagering game machine 1800 can be any type of wagering game machine and can have varying structures and methods of operation. For example, the wagering game machine 1800 can be an electromechanical wagering game machine configured to play mechanical slots, or it can be an electronic wagering game machine configured to play video casino games, such as blackjack, slots, keno, poker, blackjack, roulette, etc.

The wagering game machine 1800 comprises a housing 1812 and includes input devices, including value input devices 1818 and a player input device 1824. In one embodiment, the player input device 1824 includes one of the button panel embodiments described above. For output, the wagering game machine 1800 includes a primary display 1814 for displaying information about a basic wagering game. The primary display 1814 can also display information about a bonus wagering game and a progressive wagering game. The wagering game machine 1800 also includes a secondary display 1816 for displaying wagering game events, wagering game outcomes, and/or signage information. While some components of the wagering game machine 1800 are described herein, numerous other elements can exist and can be used in any number or combination to create varying forms of the wagering game machine 1800.

The value input devices 1818 can take any suitable form and can be located on the front of the housing 1812. The value input devices 1818 can receive currency and/or credits inserted by a player. The value input devices 1818 can include coin acceptors for receiving coin currency and bill acceptors for receiving paper currency. Furthermore, the value input devices 1818 can include ticket readers or barcode scanners for reading information stored on vouchers, cards, or other tangible portable storage devices. The vouchers or cards can authorize access to central accounts, which can transfer money to the wagering game machine 1800.

The player input device 1824 comprises a plurality of push buttons on a button panel 1826 for operating the wagering game machine 1800. In addition, or alternatively, the player input device 1824 can comprise a touch screen 1828 mounted over the primary display 1814 and/or secondary display 1816.

The various components of the wagering game machine 1800 can be connected directly to, or contained within, the housing 1812. Alternatively, some of the wagering game machine's components can be located outside of the housing 1812, while being communicatively coupled with the wagering game machine 1800 using any suitable wired or wireless communication technology.

The operation of the basic wagering game can be displayed to the player on the primary display 1814. The primary display 1814 can also display a bonus game associated with the basic wagering game. The primary display 1814 can include a cathode ray tube (CRT), a high resolution liquid crystal display (LCD), a plasma display, light emitting diodes (LEDs), or any other type of display suitable for use in the wagering game machine 1800. Alternatively, the primary display 1814 can include a number of mechanical reels to display the outcome. In FIG. 18, the wagering game machine 1800 is an "upright" version in which the primary display 1814 is oriented vertically relative to the player. Alternatively, the wagering game machine can be a "slant-top" version in which the primary display 1814 is slanted at about a thirty-degree angle toward the player of the wagering game machine 1800. In yet another embodiment, the wagering game machine 1800 can exhibit any suitable form factor, such as a free standing model, bartop model, mobile handheld model, or workstation console model.

A player begins playing a basic wagering game by making a wager via the value input device 1818. The player can initiate play by using the player input device's buttons or touch screen 1828. The basic game can include arranging a plurality of symbols along a payline 1832, which indicates one or more outcomes of the basic game. Such outcomes can be randomly selected in response to player input. At least one of the outcomes, which can include any variation or combination of symbols, can trigger a bonus game.

In some embodiments, the wagering game machine 1800 can also include an information reader 1852, which can include a card reader, ticket reader, bar code scanner, RFID transceiver, or computer readable storage medium interface. In some embodiments, the information reader 1852 can be used to award complimentary services, restore game assets, track player habits, etc.

Wagering Game Networks

Figure 19:
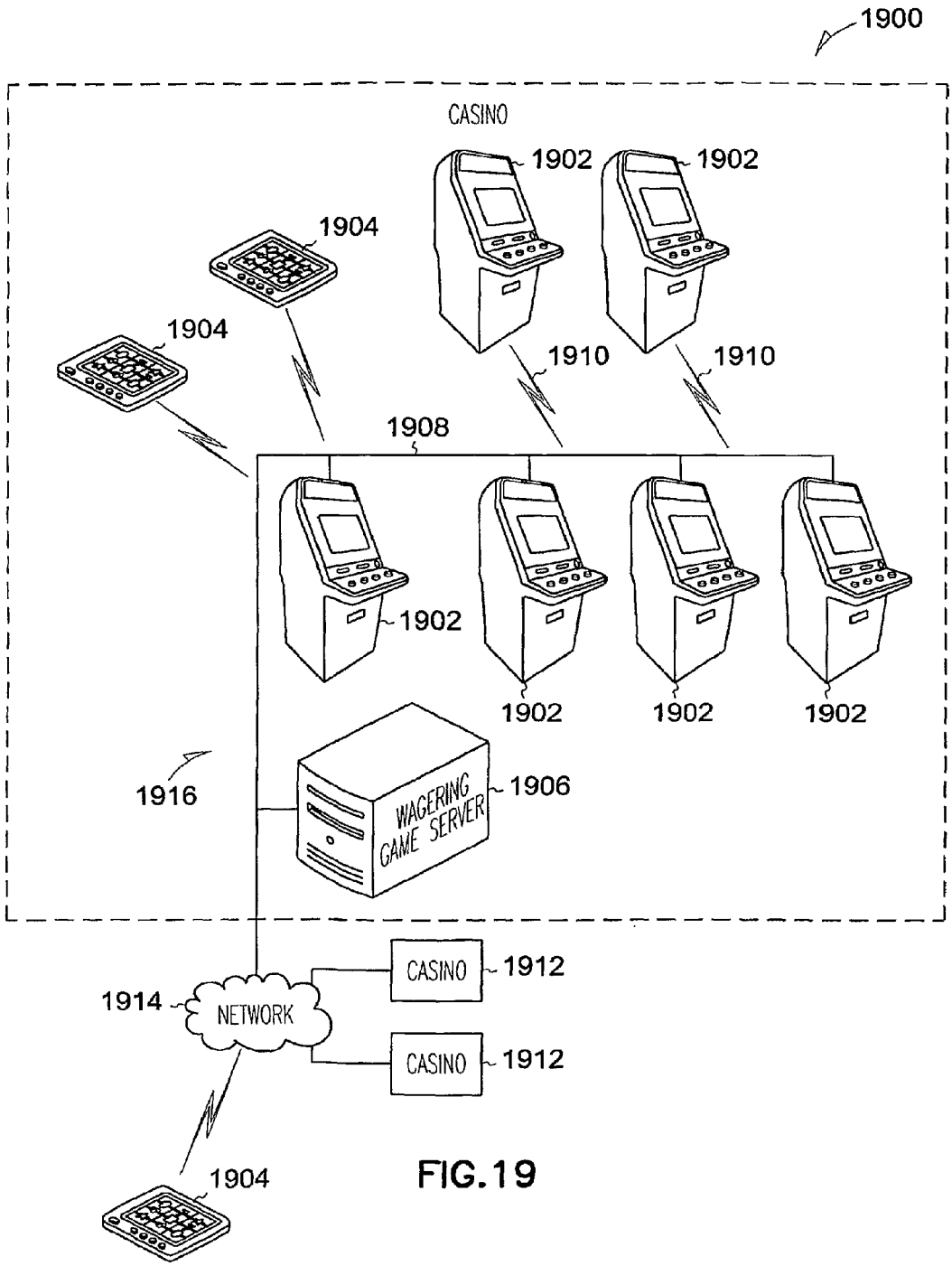
FIG. 19 is a block diagram illustrating a wagering game network, according to example embodiments of the invention.

FIG. 19 is a block diagram illustrating a wagering game network, according to example embodiments of the invention. As shown in FIG. 19, the wagering game network 1900 includes a plurality of casinos 1912 connected to a communications network 1914.

Each of the plurality of casinos 1912 includes a local area network 1916, which includes a wireless access point 1904, wagering game machines 1902, and a wagering game server 1906 that can serve wagering games over the local area network 1916. As such, the local area network 1916 includes wireless communication links 1910 and wired communication links 1908. The wired and wireless communication links can employ any suitable connection technology, such as Bluetooth, 802.11, Ethernet, public switched telephone networks, SONET, etc. In one embodiment, the wagering game server 1906 can serve wagering games and/or distribute content to devices located in other casinos 1912 or at other locations on the communications network 1914.

The wagering game machines 1902 and wagering game server 1906 can include hardware and machine-readable media including instructions for performing the operations described herein. Additionally, the wagering game machines can include any of the button panels described above.

The wagering game machines 1902 described herein can take any suitable form, such as floor standing models, handheld mobile units, bartop models, workstation-type console models, etc. Further, the wagering game machines 1902 can be primarily dedicated for use in conducting wagering games, or can include non-dedicated devices, such as mobile phones, personal digital assistants, personal computers, etc. In one embodiment, the wagering game network 1900 can include other network devices, such as accounting servers, wide area progressive servers, player tracking servers, and/or other devices suitable for use in connection with embodiments of the invention.

General

In the following detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The following detailed description does not, therefore, limit embodiments of the invention, which are defined only by the appended claims.

Each of the embodiments described herein are contemplated as falling within the inventive subject matter, which is set forth in the following claims.

What is claimed is:

1. An apparatus comprising:

a button panel for a wagering game machine comprising, a main button circuit board;

at least one socket mounted to the main button circuit board; and a display component plugged into the at least one socket, wherein the display component comprises a display coupled to a display circuit board, wherein at least one switch used to determine a button press is mounted on the display circuit board and wherein the at least one switch to determine a button press is not mounted on the main button circuit board.

2. The apparatus of claim 1, wherein a number of the at least one switch mounted on the first display circuit board is different from a number of the at least one switch mounted on a second display circuit board.

3. The apparatus of claim 1, wherein the at least one switch comprises at least one optical switch.

4. The apparatus of claim 3, wherein the at least one optical switch comprises a light receiver and a light source.

5. The apparatus of claim 4, wherein the light receiver comprises a phototransistor and the light source comprises a light emitting diode.

6. The apparatus of claim 1, wherein the display comprises organic light emitting diodes.

7. The apparatus of claim 1, further comprising a lenticular acrylic sheet laid over the display.

8. The apparatus of claim 7, wherein the lenticular acrylic sheet comprises 75 lenses per inch.

9. An apparatus of claim 1, further comprising:

a button panel for a wagering game machine comprising, a main button circuit board;

at least one socket mounted to the main button circuit board;

a display component plugged into the at least one socket, wherein the display component comprises a display coupled to a display circuit board, wherein at least one switch used to determine a button press is mounted on the display circuit board; and at least one actuator having legs, wherein a lower part of the legs extend down through holes on the main button circuit board, wherein an upper part of the legs of the at least one actuator extend through holes of the display circuit board of the number of display components;

wherein the display circuit board comprises a microcontroller to control the display.

10. The apparatus of claim 7, wherein the at least one actuator comprises a tab flag positioned between the light receiver and light source, wherein the tab flag is to selectively block light from being transmitted from the light source to the light receiver.

11. The apparatus of claim 8, wherein the tab flag is to not block the light while the button press is occurring, wherein the microcontroller is to not process receipt of light by the light receiver as a button press during a time period of operation of the wagering game machine where a button press is not an acceptable input operation.

12. A button panel assembly for a wagering game machine comprising:

a main button circuit board;

at least one socket mounted to the main button circuit board; and a display component plugged into the at least one socket, wherein the display component comprises a display coupled to a display circuit board, wherein at least one switch used to determine a button press is mounted on the display circuit board and wherein the at least one switch to determine a button press is not mounted on the main button circuit board.

13. The button panel assembly of claim 12, wherein a number of the at least one switch mounted on the display circuit board is different from a number of the at least one switch mounted on a second display circuit board.

14. The button panel assembly of claim 12, wherein the at least one switch comprises at least one optical switch.

15. The button panel assembly of claim 14, wherein the at least one optical switch comprises a light receiver and a light source.

16. The button panel assembly of claim 15, wherein the light receiver comprises a phototransistor and the light source comprises a light emitting diode.

17. The button panel assembly of claim 12, wherein the display comprises organic light emitting diodes.

18. The button panel assembly of claim 12, further comprising a lenticular acrylic sheet laid over the display.

19. The button panel assembly of claim 18, wherein the lenticular acrylic sheet comprises 75 lenses per inch.

20. A wagering game machine comprising:

a cabinet;

a central processing unit (CPU) disposed within the cabinet, the CPU to control presentation of a number of wagering games;

a button panel mounted to the cabinet, the button panel comprising:

a main button circuit board;

at least one socket mounted to the main button circuit board; and a display component plugged into the at least one socket, wherein the display component comprises a display coupled to a display circuit board, wherein at least one switch used to determine a button press is mounted on the display circuit board and wherein the at least one switch to determine a button press is not mounted on the main button circuit board.

21. The wagering game machine of claim 20, wherein a number of the at least one switch mounted on the display circuit board is different from a number of the at least one switch mounted on a second display circuit board.

22. The wagering game machine of claim 20, wherein the at least one switch comprises at least one optical switch.

23. The wagering game machine of claim 22, wherein the at least one optical switch comprises a light receiver and a light source.

24. The wagering game machine of claim 23, wherein the light receiver comprises a phototransistor and the light source comprises a light emitting diode.

25. The wagering game machine of claim 20, wherein the display comprises organic light emitting diodes.

26. The wagering game machine of claim 20, further comprising a lenticular acrylic sheet laid over the display.

27. The wagering game machine of claim 26, wherein the lenticular acrylic sheet comprises 75 lenses per inch.

* * * * *

UNITED STATES PATENT AND TRADEMARK OFFICE

CERTIFICATE OF CORRECTION

PATENT NO. : 8,734,248 B2
APPLICATION NO. : 12/438223
DATED : May 27, 2014
INVENTOR(S) : Jacob C. Greenberg et al.

It is certified that error appears in the above-identified patent and that said Letters Patent is hereby corrected as shown below:

In the Claims:

On Column 16, Line 42 (Claim 2, Line 2), please delete the word "first."

On Column 16, Line 58 (Claim 9, Line 1), please delete the phrase "of claim 1, further."

Signed and Sealed this
Ninth Day of September, 2014

Michelle K. Lee

Michelle K. Lee
*Deputy Director of the United States Patent and Trademark Office*